US007223082B2

(12) United States Patent
Sato et al.

(10) Patent No.: US 7,223,082 B2
(45) Date of Patent: May 29, 2007

(54) ROTARY COMPRESSOR

(75) Inventors: Kazuya Sato, Ora-gun (JP); Kenzo Matsumoto, Ora-gun (JP); Kentaro Yamaguchi, Ora-gun (JP); Akifumi Tomiuka, Isesaki (JP); Hiromasa Aoki, Tatebayashi (JP); Midori Futakawame, Ora-gun (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 230 days.

(21) Appl. No.: 10/770,129

(22) Filed: Feb. 3, 2004

(65) Prior Publication Data

US 2004/0208769 A1 Oct. 21, 2004

(30) Foreign Application Priority Data

Mar. 25, 2003 (JP) ..... 2003-083080
Mar. 25, 2003 (JP) ..... 2003-083119
Mar. 25, 2003 (JP) ..... 2003-083168

(51) Int. Cl.
*F03C 2/00* (2006.01)
*F04C 2/00* (2006.01)

(52) U.S. Cl. ..... 418/11; 418/60; 418/94; 184/6.16

(58) Field of Classification Search ..... 418/60, 418/63, 94, 11, 99; 184/6.16, 6.18
See application file for complete search history.

(56) References Cited

U.S. PATENT DOCUMENTS 5,242,280 A * 9/1993 Fujio ..... 418/11
5,685,703 A 11/1997 Fukuoka et al.
6,732,542 B2 * 5/2004 Yamasaki et al. ..... 418/11
2003/0068236 A1 * 4/2003 Tadano et al. ..... 418/60
2004/0071576 A1 * 4/2004 Matsumoto et al. ..... 418/11

FOREIGN PATENT DOCUMENTS

JP 63-50696 3/1988
JP 63162991 A * 7/1988
JP 4-159489 6/1992
JP 06307364 A * 11/1994
JP 2507047 4/1996
JP 2000205164 7/2000
JP 2001-073977 3/2001
JP 2002-276578 9/2002
JP 2003097476 A * 4/2003

OTHER PUBLICATIONS

Communication—European Search Report dated Jul. 9, 2004.

* cited by examiner

*Primary Examiner*—Theresa Trieu
(74) *Attorney, Agent, or Firm*—Westerman, Hattori, Daniels & Adrian, LLP.

(57) ABSTRACT

A so-called internal intermediate pressure multistage compression type rotary compressor makes it possible to prevent the pressure inside a roller from inconveniently increasing and also to permit smooth and reliable supply of oil into a cylinder of a second rotary compressing element by a relatively simple construction. A lubrication groove for providing communication between an oil bore and a low-pressure chamber in the cylinder is formed in a surface of an intermediate partitioner that is adjacent to the cylinder of the second rotary compressing element. Furthermore, a through bore for providing communication between a hermetically sealed vessel and the inside of the roller is formed in the intermediate partitioner.

4 Claims, 10 Drawing Sheets

ROTARY COMPRESSOR

BACKGROUND OF THE INVENTION

The present invention relates to a rotary compressor equipped with first and second rotary compressing elements driven by a rotary shaft of a driving element, which are accommodated in a hermetically sealed vessel.

In this type of conventional rotary compressor, especially an internal intermediate pressure multistage compression type rotary compressor, a refrigerant gas is introduced through a suction port of the first rotary compression element into a low-pressure chamber of a cylinder wherein the refrigerant gas is compressed to have an intermediate pressure by a roller and a vane, and then discharged from a high-pressure chamber of the cylinder into the hermetically sealed vessel through the intermediary of a discharge port and a discharge muffling chamber. The refrigerant gas having the intermediate pressure in the hermetically sealed vessel is then drawn into the low-pressure chamber of the cylinder through a suction port of the second rotary compressing element and subjected to second-stage compression by the roller and the vane. This causes the refrigerant gas to turn into a hot, high-pressure refrigerant gas, which flows from the high-pressure chamber into an external radiator or the like through the intermediary of the discharge port and the discharge muffling chamber (refer to, for example, Japanese Patent No. 2507047).

The rotary shaft has an oil bore vertically formed around an axial center thereof and a horizontal lubrication bore in communication with the oil bore. Oil is drawn up from an oil reservoir located at bottom inside the hermetically sealed vessel 12 by an oil pump, serving as a lubricating device, installed at the bottom end of the rotary shaft. The oil moves up through the oil bore to be supplied to the rotary shaft and sliding portions in the rotary compressing elements through the lubrication bore, thereby to accomplish lubrication and sealing.

If a refrigerant exhibiting a considerable high/low pressure difference, such as carbon dioxide ($CO_2$), which is a natural refrigerant, is used in the abovementioned rotary compressor, then the refrigerant pressure reaches 12 MPaG in the second rotary compressing element, which is the high pressure side, while it reaches 8 MPaG (intermediate pressure) in the first rotary compressing element, which is the low pressure side.

In such a rotary compressor, an upper open surface of the cylinder of the second rotary compressing element is closed by a supporting member, and the lower open surface thereof is closed with an intermediate partitioner. A roller is provided in a cylinder of the second rotary compressing element. The roller is fitted to an eccentric member of the rotary shaft. For a design reason or for preventing wear on the roller, a small gap is formed between the roller and the supporting member disposed above the roller, and between the roller and the intermediate partitioner disposed under the roller. These gaps inconveniently allow a high-pressure refrigerant gas, which has been compressed by the cylinder of the second rotary compressing element, to enter into the roller (a space around the eccentric member inside the roller). Thus, the high-pressure refrigerant gas accumulates inside the roller.

The high-pressure refrigerant gas built up inside the roller causes the pressure inside the roller to become higher than the pressure (intermediate pressure) of the hermetically sealed vessel, which has its bottom portion serving as the oil reservoir. This makes it extremely difficult to supply oil to the inside of the roller from the lubrication bore through the oil bore in the rotary shaft by utilizing a pressure difference, resulting in shortage of a lubricant to the area around the eccentric member inside the roller.

As a conventional solution to the abovementioned problem, a passage 200 that provides communication between the inside of the roller (adjacent to the eccentric member) of the second rotary compressing element and the interior of the hermetically sealed vessel has been formed in the upper supporting member 201 disposed above the cylinder of the second rotary compressing element, as shown in FIG. 16. The passage 200 releases the high-pressure refrigerant gas accumulated inside the roller into the hermetically sealed vessel so as to prevent the pressure inside the roller from rising to a high level.

However, to form the passage 200 for the communication between the inside of the roller and the hermetically sealed vessel, two passages have to be formed by machining, namely, a passage 200A formed in an inner edge portion of the upper supporting member 201 in an axial direction that opens adjacently to the inside of the roller, and a horizontal passage 200B for providing communication between the passage 200A and the hermetically sealed vessel. This has been posing a problem of increased machining cost for forming the passages with resultant higher production cost.

Furthermore, the pressure (high pressure) in the cylinder of the second rotary compressing element becomes higher than the pressure (intermediate pressure) in the hermetically sealed vessel having its bottom portion serving as the oil reservoir. This makes it extremely difficult to supply oil through the oil bore and the lubrication bore in the rotary shaft into the cylinder of the second rotary compressing element by utilizing a pressure difference. As a result, lubrication is performed only by the oil in a refrigerant drawn in, thus posing a problem of insufficient lubrication.

Furthermore, in the internal intermediate pressure multistage compression type rotary compressor, the pressure in the cylinder (high pressure) of the second rotary compressing element rises higher than the pressure in the hermetically sealed vessel (intermediate pressure) having its bottom portion serving as the oil reservoir. This makes it extremely difficult to supply oil through the oil bore in the rotary shaft into the cylinder by utilizing a pressure difference. As a result, lubrication is performed only by the oil in a refrigerant drawn in, thus posing a problem of insufficient lubrication.

Thus, the intermediate partitioner and the cylinder of the second rotary compressing element have to be provided with small bores to provide communication between the oil bore of the rotary shaft and the inlet port of the cylinder so as to supply oil to the second rotary compressing element. This, however, has been posing a problem of increased production cost because of the need for forming the small bores in the intermediate partitioner and the cylinder.

SUMMARY OF THE INVENTION

Accordingly, the present invention has been made with a view toward solving the problems with the prior art described above, and it is an object thereof to provide a so-called internal intermediate pressure multistage compression type rotary compressor capable of restraining a pressure inside a roller from inconveniently increasing and also of permitting smooth and reliable lubrication of a cylinder of a second rotary compressing element by a relatively simple construction.

It is another object of the present invention to provide an internal intermediate pressure multistage compression type rotary compressor that allows a lubricant to be supplied smoothly and reliably into a cylinder of a second rotary compressing element, whose pressure therein reaches a high level, at low cost.

According to one aspect of the present invention, there is provided a so-called internal intermediate pressure multistage compression type rotary compressor having: a first cylinder for constituting a first rotary compressing element and a second cylinder for constituting a second rotary compressing element; a roller that is provided in each of the cylinders and fitted onto an eccentric member of the rotary shaft to eccentrically rotate; an intermediate partitioner provided between the cylinders and the rollers to partition the rotary compressing elements; supporting members that close open surfaces of the cylinders and have bearings for the rotary shaft; and an oil bore formed in the rotary shaft, wherein a surface of the intermediate partitioner that is adjacent to the second cylinder has a groove for communication between the oil bore and a low-pressure chamber in the second cylinder, and the intermediate partitioner has a through bore for communication between an interior of a hermetically sealed vessel and the inside of the rollers. The through bore formed in the intermediate partitioner allows a high-pressure refrigerant gas accumulating inside the rollers to be released into the hermetically sealed vessel.

Moreover, even if the pressure in the second cylinder of the second rotary compressing element becomes higher than that in the hermetically sealed vessel having an intermediate pressure, a suction pressure loss in the course of suction in the second rotary compressing element can be utilized to reliably supply oil into a low-pressure chamber of the second cylinder of the second rotary compressing element through the oil bore of the rotary shaft through the intermediary of the groove formed in the intermediate partitioner.

According to another aspect of the present invention, there is provided a so-called internal intermediate pressure multistage compression type rotary compressor having: a first cylinder for constituting a first rotary compressing element and a second cylinder for constituting a second rotary compressing element; a roller that is provided in each of the cylinders and fitted onto an eccentric member of the rotary shaft to eccentrically rotate; an intermediate partitioner provided between the cylinders and the rollers to partition the rotary compressing elements; supporting members that close open surfaces of the cylinders and have bearings for the rotary shaft; and an oil bore formed in the rotary shaft, wherein a surface of the intermediate partitioner that is adjacent to the second cylinder has a groove extended from an inner periphery to an outer periphery of the intermediate partitioner to provide communication among the oil bore and the insides of the rollers, a low-pressure chamber in the second cylinder, and the hermetically sealed vessel. The groove formed so as to extend from the inner periphery to the outer periphery of the intermediate partitioner allows a high-pressure refrigerant gas accumulating inside the rollers to be released into the hermetically sealed vessel.

Moreover, even if the pressure in the second cylinder of the second rotary compressing element becomes higher than that in the hermetically sealed vessel having an intermediate pressure, a suction pressure loss generated in the course of suction in the second rotary compressing element can be utilized to reliably supply oil into a low-pressure chamber of the second cylinder of the second rotary compressing element through the oil bore of the rotary shaft through the intermediary of the groove formed in the intermediate partitioner.

Preferably, the driving element is an rpm-controlled motor started up at low speed upon actuation.

According to yet another aspect of the present invention, there is provided a rotary compressor having: a first cylinder for constituting a first rotary compressing element and a second cylinder for constituting a second rotary compressing element; an intermediate partitioner provided between the cylinders to partition the rotary compressing elements; supporting members that close open surfaces of the cylinders and have bearings for the rotary shaft of the driving element; and an oil bore formed in the rotary shaft, wherein a lubrication bore for communication between the oil bore and a low-pressure chamber in the second cylinder is formed in the intermediate partitioner. With this arrangement, even if the pressure in the cylinder of the second rotary compressing element becomes higher than that in the hermetically sealed vessel having an intermediate pressure, a suction pressure loss generated in the course of suction in the second rotary compressing element can be utilized to reliably supply oil into the cylinder through the lubrication bore formed in the intermediate partitioner.

DESCRIPTION OF THE PREFERRED EMBODIMENTS

Figure 1:
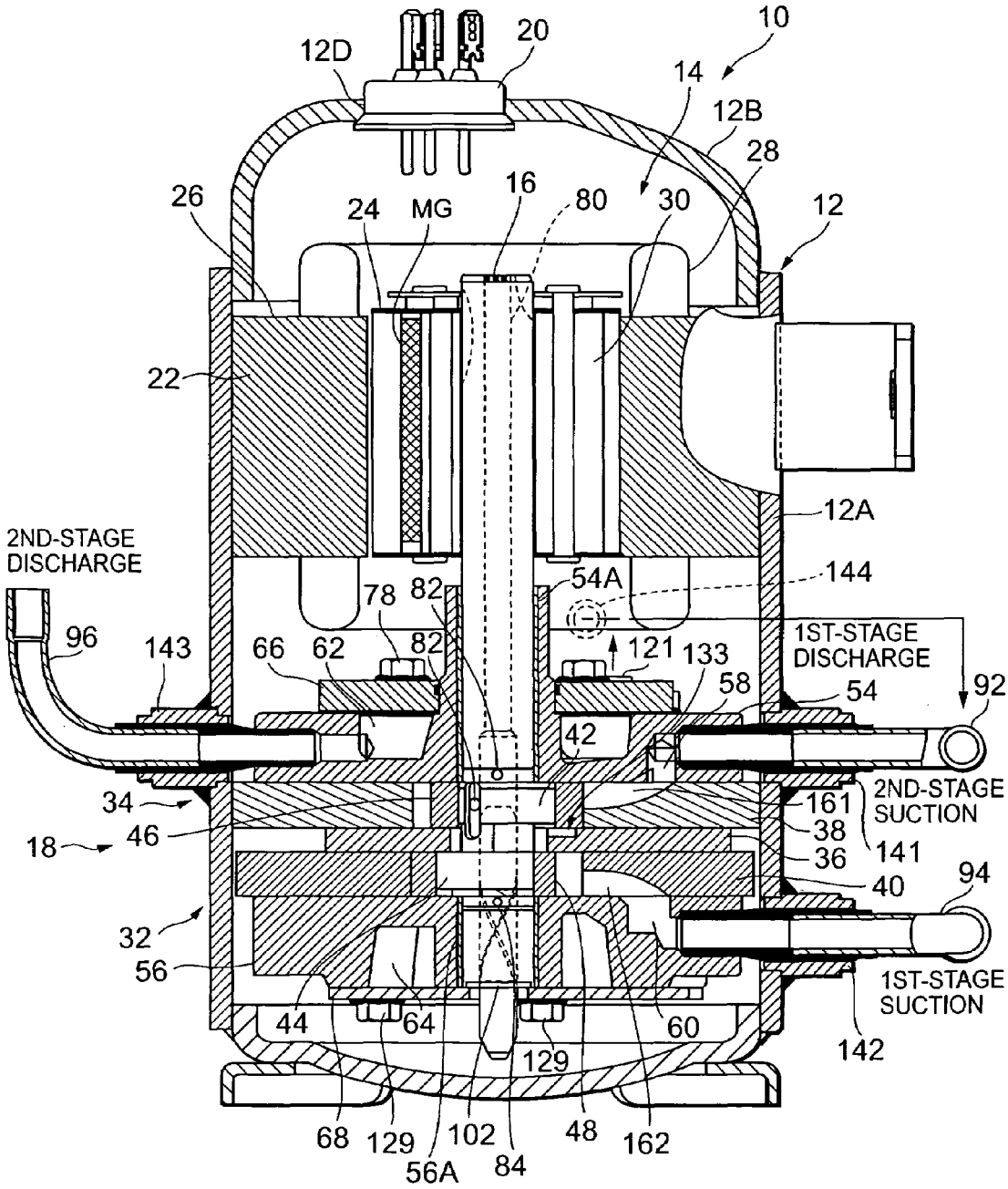
FIG. 1 is a longitudinal sectional view of an internal intermediate pressure multistage compression type rotary compressor according to an embodiment of the present invention.

Embodiments according to the present invention will be described in detail in conjunction with the attached drawings. FIG. 1 is a longitudinal sectional view of an internal intermediate pressure multistage (2-stage) compression type rotary compressor 10, which is an embodiment of a rotary compressor in accordance with the present invention. The rotary compressor 10 has a first rotary compressing element 32 and a second rotary compressing element 34.

Referring to FIG. 1, the internal intermediate pressure multistage compression type rotary compressor 10 that uses carbon dioxide ($CO_2$) as a refrigerant is constructed of a cylindrical hermetically sealed vessel 12 formed of a steel plate, a driving element 14 disposed at an upper side of the internal space of the hermetically sealed vessel 12, and a rotary compressing mechanism unit 18 that includes a first rotary compressing element 32 (first stage) and a second rotary compressing element 34 (second stage) that are disposed under the driving element 14 and driven by a rotary shaft 16 of the driving element 14.

The hermetically sealed vessel 12 having its bottom portion working as an oil reservoir is constructed of a vessel main body 12A accommodating the driving element 14 and the rotary compressing mechanism unit 18, and a substantially bowl-shaped end cap or cover 12B that closes an upper opening of the vessel main body 12A. A circular mounting hole 12D is formed at the center of an upper surface of the end cap 12B. A terminal (wires not shown) 20 for supplying electric power to the driving element 14 is installed in the mounting hole 12D.

The driving element 14 is a series-wound DC motor constructed of a stator 22 annularly installed along an upper inner peripheral surface of the hermetically sealed vessel 12 and a rotor 24 inserted in the stator 22 with a slight gap on the inner side. The rotor 24 is fixed to the rotary shaft 16 that extends in a vertical direction, passing through a center.

The stator 22 has a laminate 26 formed of stacked toroidal electromagnetic steel plates, and a stator coil 28 wound around teeth of the laminate 26 by a series winding (concentrated winding) method. The rotor 24 is also formed of a laminate 30 made of electromagnetic steel plates, as in the stator 22. A permanent magnet MG is inserted in the laminate 30.

An oil pump 102, serving as a lubricating device, is provided at the bottom end of the rotary shaft 16. The oil pump 102 draws up lubricating oil from the oil reservoir formed at the bottom of the hermetically sealed vessel 12. The lubricating oil passes through an oil bore 80 formed in a vertical direction along the axial center of the rotary shaft 16 and through horizontal lubrication bores 82 and 84 (formed also in upper and lower eccentric members 42 and 44) in communication with the oil bore 80 to reach sliding portions and the like of the upper and lower eccentric members 42 and 44, and the first and second rotary compressing elements 32 and 34. This restrains wear on the first and second rotary compressing elements 32 and 34, and also provides sealing.

The rotary compressing mechanism unit 18 includes a lower cylinder (first cylinder) 40 constituting the first rotary compressing element 32 and an upper cylinder (second cylinder) 38 constituting the second rotary compressing element 34, upper and lower rollers 46 and 48, which eccentrically rotate, being fitted onto the upper and lower eccentric members 42 and 44, respectively, which are provided on the rotary shaft 16 with a 180-degree phase difference in the upper and lower cylinders 38 and 40, respectively, an intermediate partitioner 36 provided between the upper and lower cylinders 38 and 40 and the rollers 46 and 48 to separate the first and second rotary compressing elements 32 and 34, a vane 50 (the lower vane being not shown) abutting against the rollers 46 and 48 to separate interiors of the upper and lower cylinders 38 and 40 into low-pressure chambers and high-pressure chambers, and an upper supporting member 54 and a lower supporting member 56 that cover the upper opening surface of the upper cylinder 38 and the lower opening surface of the lower cylinder 40, respectively, and also serve as bearings of the rotary shaft 16.

The upper supporting member 54 and the lower supporting member 56 are provided with suction passages 58 and 60 in communication with the interiors of the upper and lower cylinders 38 and 40, respectively, through suction ports 161 and 162, respectively, and discharge muffling chambers 62 and 64 partly formed by recessions that are closed by an upper cover 66 and a lower cover 68, respectively. A bearing 54A is protuberantly formed at the center of the upper supporting member 54 and a bearing 56A is protuberantly formed at the center of the lower supporting member 56 to support the rotary shaft 16.

The lower cover 68 formed of a toroidal steel plate is fixed to the lower supporting member 56 from below by main bolts 129 at four peripheral locations. Distal ends of the main bolts 129 are screwed into the upper supporting member 54.

The discharge muffling chamber 64 of the first rotary compressing element 32 and the interior of the hermetically sealed vessel 12 are in communication through a communication passage. The communication passage is formed of a bore (not shown) that penetrates the lower supporting member 56, the upper supporting member 54, the upper cover 66, the upper and lower cylinders 38 and 40, and the intermediate partitioner 36. In this case, an intermediate discharge pipe 121 is vertically provided at the upper end of the communication passage, and an intermediate-pressure refrigerant is discharged through the intermediate discharge pipe 121 into the hermetically sealed vessel 12.

The upper cover 66 closes the upper surface opening of the discharge muffling chamber 62 in communication with the interior of the upper cylinder 38 of the second rotary compressing element 34 through a discharge port 39. The driving element 14 is provided above the upper cover 66 with a predetermined gap therebetween in the hermetically sealed vessel 12. A peripheral portion of the upper cover 66 is fixed to the upper supporting member 54 from above by four main bolts 78. The distal ends of the main bolts 78 are screwed in the lower supporting members 56.

Figure 2:
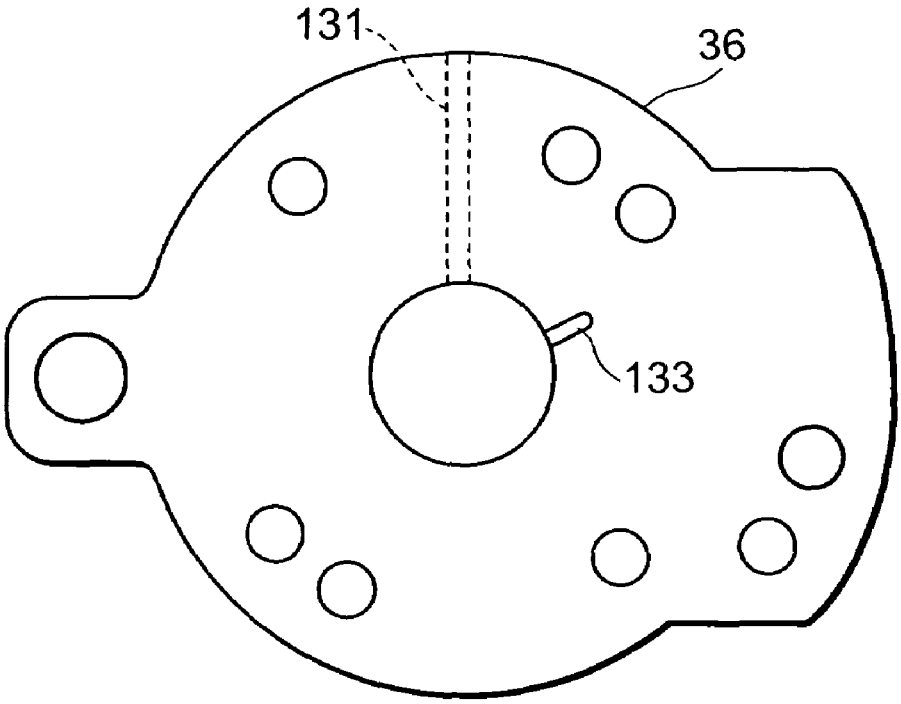
FIG. 2 is a top plan view of an intermediate partitioner of the rotary compressor shown in FIG. 1.
Figure 4:
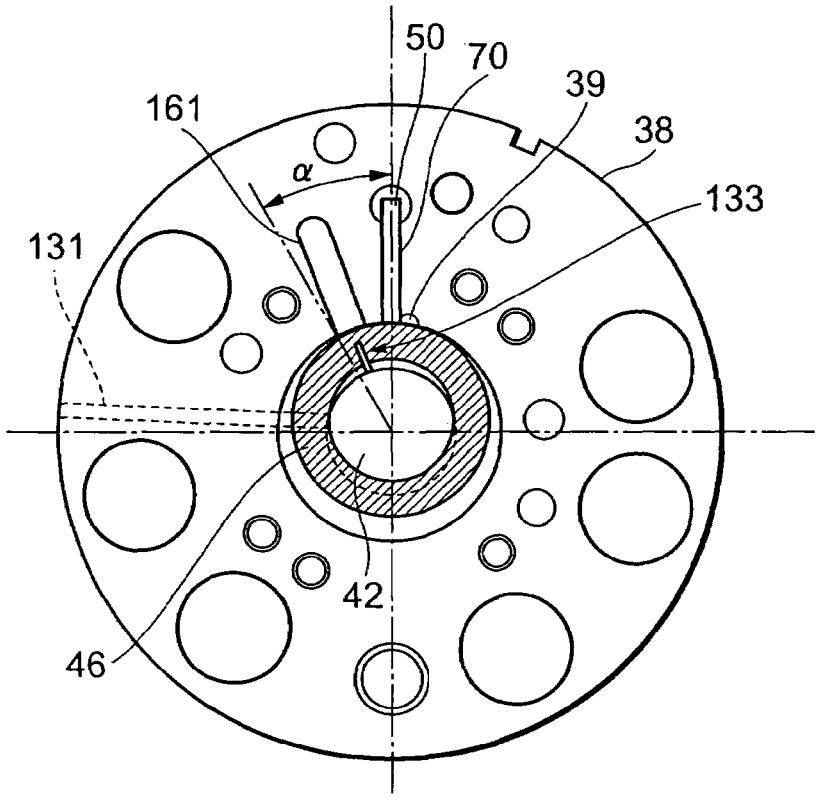
FIG. 4 is a top plan view of an upper cylinder of a second rotary compressing element of the rotary compressor shown in FIG. 1.

The intermediate partitioner 36 has a through bore 131 providing communication between the interior of the hermetically sealed vessel 12 and inside the roller 46 by small-diameter boring, as shown in FIGS. 2 and 4. FIG. 2 is a top plan view of the intermediate partitioner 36, and FIG. 4 is a top plan view of the upper cylinder 38 of the second rotary compressing element 34. An accommodating chamber 70 is formed in the upper cylinder 38. The vane 50 is housed in the accommodating chamber 70 and abutted against the roller 46. One side (right side in FIG. 4) of the vane 50 has the discharge port 39, while the other side (left) with the vane 50 therebetween has the suction port 161. The vane 50 separates compression chambers formed between the upper cylinder 38 and the roller 46 into low-pressure chambers LR and high-pressure chambers HR. The suction port 161 is associated with the low-pressure chambers LR, while the discharge port 39 is associated with the high-pressure chambers HR.

A small gap is formed between the intermediate partitioner 36 and the rotary shaft 16, an upper side of the gap being in communication with the inside of the roller 46 (the space around the eccentric member 42 inside the roller 46). Furthermore, a lower side of the gap between the intermediate partitioner 36 and the rotary shaft 16 is in communication with the inside of the roller 48 (the space around the eccentric member 44 inside the roller 48). The through bore 131 serves as a passage for releasing, into the hermetically sealed vessel 12, a high-pressure refrigerant gas that leaks into the roller 46 (the space around the eccentric member 42 inside the roller 46) through a gap formed between the roller 46 in the cylinder 38 and the upper supporting member 54 closing the upper open surface of the cylinder 38 or the intermediate partitioner 36 closing the lower open surface, and then flows into the gap between the intermediate partitioner 36 and the rotary shaft 16 and inside the roller 48.

The high-pressure refrigerant gas leaking inside the roller 46 passes through the gap between the intermediate partitioner 36 and the rotary shaft 16 and enters the through bore 131, thus flowing out into the hermetically sealed vessel 12.

Thus, the high-pressure refrigerant gas leaking inside the roller 46 can be released through the through bore 131 into the hermetically sealed vessel 12. This makes it possible to avoid the inconvenience of the high-pressure refrigerant gas accumulating inside the roller 46, in the gap between the intermediate partitioner 36 and the rotary shaft 16, and inside the roller 48. With this arrangement, oil can be supplied inside the roller 4!6 and the roller 48 through the lubrication bores 82 and 84 of the rotary shaft 16 by making use of a pressure difference.

An increase in machining cost can be minimized particularly because a high-pressure refrigerant gas leaked into the roller 46 can be released into the hermetically sealed vessel 12 simply by forming the through bore 131 horizontally penetrating the intermediate partitioner 36.

Figure 3:
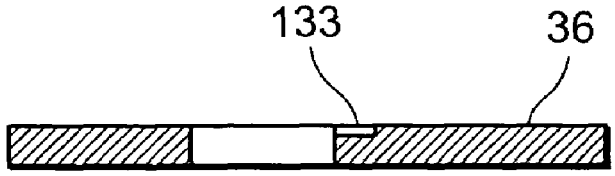
FIG. 3 is a longitudinal sectional view of the intermediate partitioner of the rotary compressor shown in FIG. 1.

The surface of the intermediate partitioner 36 that is adjacent to the cylinder 38 has a lubrication groove 133 extending from the inner peripheral surface over a predetermined distance in a radial direction, as shown in FIG. 2 to FIG. 4. The lubrication groove 133 is formed under an area $\alpha$ extending from a position where the vane 50 of the cylinder 38 shown in FIG. 4 abuts against the roller 46 to an edge on the opposite side from the vane 50 of the suction port 161. An outer portion of the lubrication groove 133 is in communication with the low-pressure chamber LR of the cylinder 38.

An opening on the inner peripheral surface side of the lubrication groove 133 of the intermediate partitioner 36 is in communication with the oil bore 80 through the intermediary of the lubrication bores 82 and 84. Thus, the lubrication groove 133 provides communication between the oil bore 80 and the low-pressure chamber LR in the upper cylinder 38.

As will be discussed later, the hermetically sealed vessel 12 will have an intermediate pressure therein, so that supply of oil into the upper cylinder 38, which is the second stage and will have a high pressure therein, is difficult. However, the lubrication groove 133 formed in the intermediate partitioner 36 allows oil drawn up by the oil pump 102 from the oil reservoir at the inner bottom of the hermetically sealed vessel 12 to move up in the oil bore 80 into the lubrication bores 82 and 84, and then enter the lubrication groove 133 of the intermediate partitioner 36, thus being supplied to the low-pressure chamber LR of the upper cylinder 38.

Figure 5:
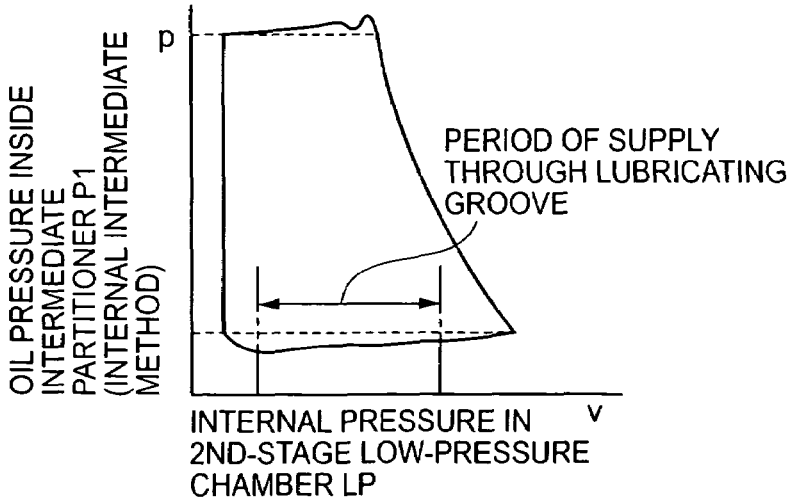
FIG. 5 is a diagram showing changes in pressure at an inlet end of the upper cylinder of the rotary compressor shown in FIG. 1.

FIG. 5 shows changes in pressure in the upper cylinder 38, P1 in the diagram denoting a pressure on the inner peripheral side of the intermediate partitioner 36. The internal pressure (suction pressure) of the low-pressure chamber LR of the upper cylinder 38 denoted by LP in the diagram drops lower than the pressure P1 on the inner peripheral surface side of the intermediate partitioner 36 due to a suction pressure loss in a suction stroke. During that particular period, oil is injected through the oil bore 80 of the rotary shaft 16 into the low-pressure chamber LR in the upper cylinder 38 through the lubrication groove 133 of the intermediate partitioner 36, thus accomplishing lubrication.

Figure 6:
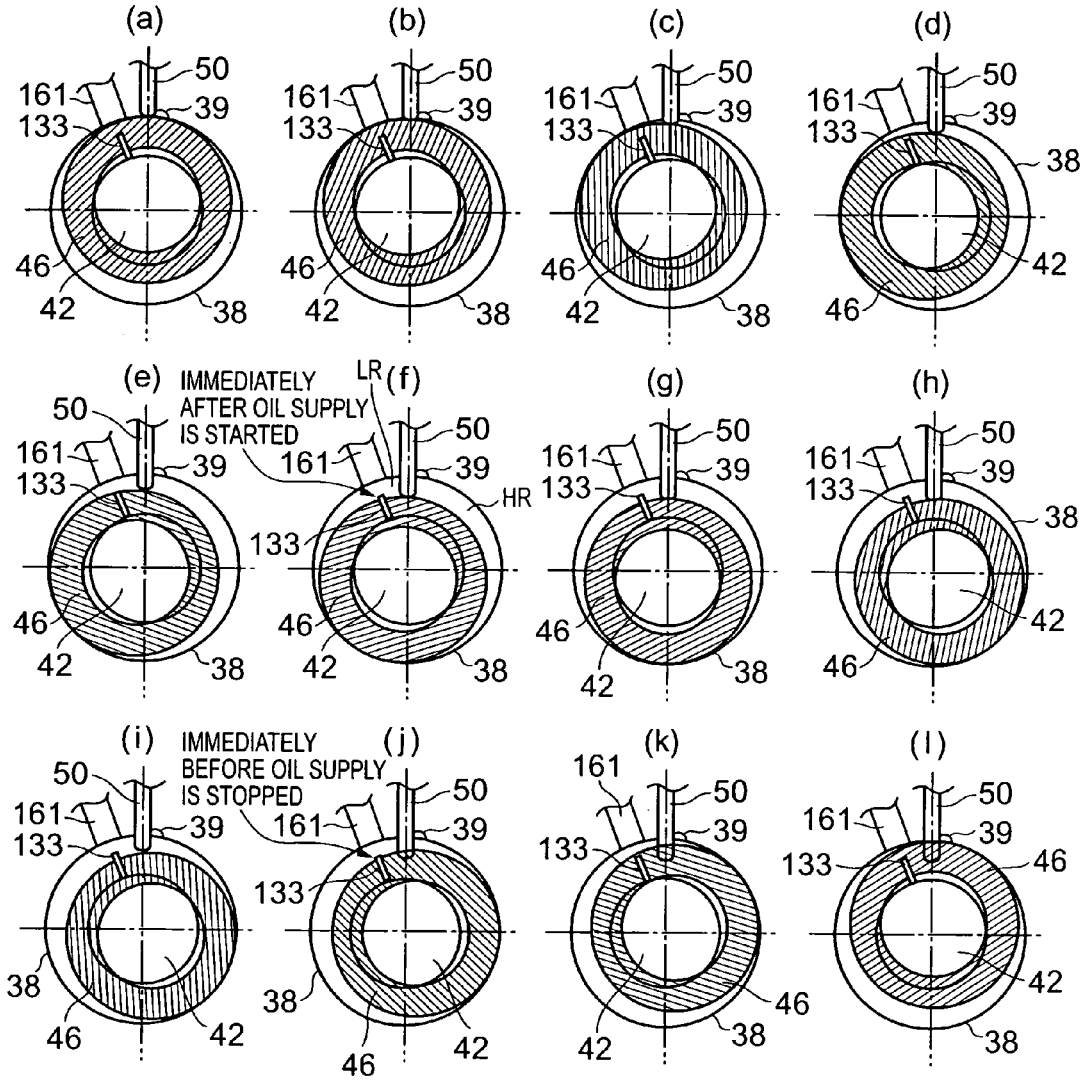
FIG. 6 is a diagram illustrating a stroke of suction-compression of a refrigerant performed by the upper cylinder of the rotary compressor shown in FIG. 1.

FIG. 6A through FIG. 6L illustrate a refrigerant suction-compression stroke of the upper cylinder 38 of the second rotary compressing element 34. If it is assumed that the eccentric member 42 of the rotary shaft 16 rotates counter-clockwise in the figures, then the suction port 161 is closed by the roller 46 in FIGS. 6A and 6B. In FIG. 6C, the suction port 161 opens and suction of a refrigerant is begun, while a refrigerant is being discharged at the opposite side. The suction of the refrigerant continues during the steps of FIGS. 6C to 6E. During this period, the lubrication groove 133 is covered by the roller 46.

In FIG. 6F, the roller 46 exposes the lubrication groove 133, so that the oil is drawn into the low-pressure chamber LR surrounded by the vane 50 and the roller 46 in the upper cylinder 38, beginning the lubrication (the beginning of the supply period shown in FIG. 5). From steps shown in FIGS. 6G to 6I, the suction of the oil is performed. The lubrication continues until the upper side of the lubrication groove 133 is covered by the roller 46 in FIG. 6J, thus stopping the lubrication (the end of the supply period shown in FIG. 5). From steps shown in FIGS. 6K through 6L to FIGS. 6A and 6B, suction of a refrigerant is carried out. Thereafter, the refrigerant will be compressed and discharged through the discharge port 39.

Thus, even if the pressure in the upper cylinder 38 of the second rotary compressing element 34 becomes higher than the intermediate pressure in the hermetically sealed vessel 12, the lubrication groove 133 allows oil to be securely supplied into the upper cylinder 38 by making use of a suction pressure loss during a suction stroke in the second rotary compressing element 34.

With this arrangement, the second rotary compressing element 34 can be securely lubricated, permitting performance to be secured and reliability to be improved. In particular, oil can be supplied into the upper cylinder 38 of the second rotary compressing element 34 simply by forming the groove in the surface of the intermediate partitioner 36 that is adjacent to the cylinder 38. This obviates the need for forming thin bores in the intermediate partitioner 36 and the upper cylinder 38, as in the prior art. With this arrangement, the construction can be simplified, so that an increase in production cost can be restrained.

Moreover, a bore for releasing high pressures (the through bore 131) formed inside the roller 46, and the groove for supplying oil (the lubrication groove 133) are separately formed, so that the configuration of the lubrication groove 133 for supplying oil can be changed as desired. This means that, if a groove or bore is to be used to release high pressures inside the roller 46 and also to supply oil, then the groove or the bore has to have a certain size or diameter to release the high pressures inside the roller 46. An excessively small diameter of the groove or bore would fail to adequately release a high-pressure gas accumulating inside the roller 46. On the other hand, an excessively large diameter thereof would cause excessive oil to be supplied and discharged from the compressor 10, and may adversely affecting a refrigerant cycle or cause shortage of oil in the compressor 10.

The high pressure releasing bore (the through bore 131) inside the roller 46 and the oil supplying groove (the lubrication groove 133) are separately formed, so that the groove diameter of the through bore 131 and the size of the lubrication groove 133 can be freely adjusted. Furthermore, the amount of oil supplied to the low-pressure chamber LR of the upper cylinder 38 can be adjusted by adjusting the size of the lubrication groove 133.

Thus, high pressure inside the roller 46 can be released and oil can be supplied to the upper cylinder 38 of the second rotary compressing element 34 at low cost. In addition, secured performance and higher reliability of the rotary compressor 10 can be achieved.

In this case, carbon dioxide ($CO_2$), which is a natural refrigerant gentle to the global environment, is used, considering flammability, toxicity, etc. Oil sealed in the hermetically sealed vessel 12 as a lubricant may be an existing oil, such as a mineral oil, alkyl benzene oil, ether oil, ester oil, and polyalkylene glycol (PAG).

A side surface of the vessel main body 12A of the hermetically sealed vessel 12 has sleeves 141, 142, 143, and 144 welded and fixed at positions matching the positions of the suction passages 58 and 60 of the upper supporting member 54 and the lower supporting member 56, the discharge muffling chamber 62, and above the upper cover 66 (a position substantially matching the bottom end of the driving element 14), respectively. The sleeves 141 and 142 are vertically adjacent, while the sleeve 143 is positioned substantially on a diagonal line with respect to the sleeve 141. Positionally, the sleeve 144 and the sleeve 141 are shifted by about 90 degrees.

One end of a refrigerant introduction pipe 92 for introducing a refrigerant gas into the upper cylinder 38 is inserted in and connected to the sleeve 141, and the end of the refrigerant introduction pipe 92 is in communication with the suction passage 58 of the upper cylinder 38. The refrigerant introduction pipe 92 is routed above the hermetically sealed vessel 12 to the sleeve 144, the other end thereof being inserted in and connected to the sleeve 144 to be in communication with the interior of the hermetically sealed vessel 12.

One end of the refrigerant introduction pipe 94 for introducing a refrigerant gas into the lower cylinder 40 is inserted in and connected to the sleeve 142, the one end of the refrigerant introduction pipe 94 being in communication with the suction passage 60 of the lower cylinder 40. A refrigerant discharge pipe 96 is inserted in and connected to the sleeve 143, one end of the refrigerant discharge pipe 96 being in communication with the discharge muffling chamber 62.

An operation of the rotary compressor 10 having the aforementioned construction will now be described. Energizing the stator coil 28 of the driving element 14 via the terminal 20 and the wires (not shown) actuates the driving element 14 to rotate the rotor 24. This causes the upper and lower rollers 46 and 48 to eccentrically rotate in the upper and lower cylinders 38 and 40, respectively, the rollers 46 and 48 being fitted to the upper and lower eccentric members 42 and 44, respectively, that are integrally formed with the rotary shaft 16.

A refrigerant gas of a low pressure (4 MPaG) drawn into the low-pressure chamber of the lower cylinder 40 through the suction port 162 via the refrigerant introduction pipe 94 and the suction passage 60 formed in the lower supporting member 56 is compressed to have an intermediate pressure (8 MPaG) by the roller 48 and a vane (not shown), passes through the discharge port 41 from the high-pressure chamber of the lower cylinder 40 into the discharge muffling chamber 64 formed in the lower supporting member 56, and then it is discharged into the hermetically sealed vessel 12 through the intermediate discharge pipe 121 via a communication passage (not shown).

Then, the intermediate-pressure refrigerant gas in the hermetically sealed vessel 12 leaves the sleeve 144, passes through the refrigerant introduction pipe 92 and the suction passage 58 formed in the upper supporting member 54, and reaches the low-pressure chamber LR of the upper cylinder 38 through the suction port 161. The intermediate-pressure refrigerant gas that has been drawn in is subjected to the second-stage compression explained with reference to FIG. 6 by the roller 46 and the vane 50 so as to turn into a hot, high-pressure refrigerant gas (the pressure being about 12 MPaG). The hot, high-pressure refrigerant gas flows from the high-pressure chamber HR, passes through the discharge port 39, the discharge muffling chamber 62 formed in the upper supporting member 54, and the refrigerant discharge pipe 96, and then it is discharged to an external radiator or the like of the compressor 10.

Thus, the lubrication groove 133 formed in the surface of the intermediate partitioner 36 that is adjacent to the cylinder 38 provides communication between the oil bore 80 and the low-pressure chamber LR of the cylinder 38 through the lubrication bores 82 and 84, so that even if the pressure in the cylinder 38 of the second rotary compressing element 34 becomes higher than the intermediate pressure in the hermetically sealed vessel 12, the lubrication groove 133 allows oil to be securely supplied into the low-pressure chamber of the cylinder 38 by making use of a suction pressure loss during a suction stroke in the second rotary compressing element 34.

The through bore 131 drilled in the intermediate partitioner 36 provides communication between the interior of the hermetically sealed vessel 12 and the inside of the roller 46, so that a high-pressure refrigerant gas leaked into the inside of the roller 46 can be released into the hermetically sealed vessel 12 through the through bore 131.

With this arrangement, oil is smoothly supplied to the inside of the roller 46 and the roller 48 through the lubrication bores 82 and 84 of the rotary shaft 16 by making use of a pressure difference. This makes it possible to avoid shortage of oil around the eccentric member 42 inside the roller 46 and around the eccentric member 44 inside the roller 48.

Thus, the inconvenience of the pressure inside the roller 46 becoming high can be avoided, and smooth and reliable lubrication of the second rotary compressing element 34 can be achieved by the relatively simple construction. This feature allows the rotary compressor 10 to achieve secured performance and higher reliability.

In the present embodiment, the upper side of the gap formed between the intermediate partitioner 36 and the rotary shaft 16 is in communication with the inside of the roller 46, while the lower side thereof is in communication with the inside of the roller 48. Alternatively, however, only the upper side of the gap formed between the intermediate partitioner 36 and the rotary shaft 16 may be in communication with the inside of the roller 46, that is, the lower side thereof may not be in communication with the inside of the roller 48. Further alternatively, the inside of the roller 46 and the inside of the roller 48 may be separated by the intermediate partitioner 36. In this case also, a high pressure inside the roller 46 can be released into the hermetically sealed vessel 12 by forming a bore in an axial direction that is in communication with the inside of the roller 46 in a middle of the through bore 131 of the intermediate partitioner. Moreover, oil can be supplied to the suction end of the second rotary compressing element 32 through the lubrication bore 82.

As explained in detail above, according to the present invention, a so-called internal intermediate pressure multistage compression type rotary compressor is equipped with: a first cylinder for constituting a first rotary compressing element and a second cylinder for constituting a second rotary compressing element; a roller that is provided in each of the cylinders and fitted onto an eccentric member of the rotary shaft to eccentrically rotate; an intermediate partitioner provided between the cylinders and the rollers to partition the rotary compressing elements; supporting members that close open surfaces of the cylinders and have bearings for the rotary shaft; and an oil bore formed in the rotary shaft, wherein a surface of the intermediate partitioner that is adjacent to the second cylinder has a groove for communication between the oil bore and a low-pressure chamber in the second cylinder, and the intermediate partitioner has a through bore for communication between an interior of a hermetically sealed vessel and inside the rollers. The through bore formed in the intermediate partitioner allows a high-pressure refrigerant gas accumulating inside the rollers to be released into the hermetically sealed vessel.

With this arrangement, oil is smoothly supplied into the rollers through the oil bore of the rotary shaft by making use of a pressure difference, so that shortage of oil around the eccentric members inside the rollers can be avoided.

In addition, even if the pressure in the second cylinder of the second rotary compressing element becomes higher than that in the hermetically sealed vessel having an intermediate pressure, a suction pressure loss generated in the course of suction in the second rotary compressing element can be utilized to reliably supply oil into the low-pressure chamber of the second cylinder of the second rotary compressing element through the oil bore of the rotary shaft via the groove formed in the intermediate partitioner.

Thus, the inconvenience of the pressure inside a roller becoming high can be avoided, and reliable lubrication of a second rotary compressing element can be achieved by the relatively simple construction. This feature allows the rotary compressor to achieve secured performance and higher reliability.

Figure 7:
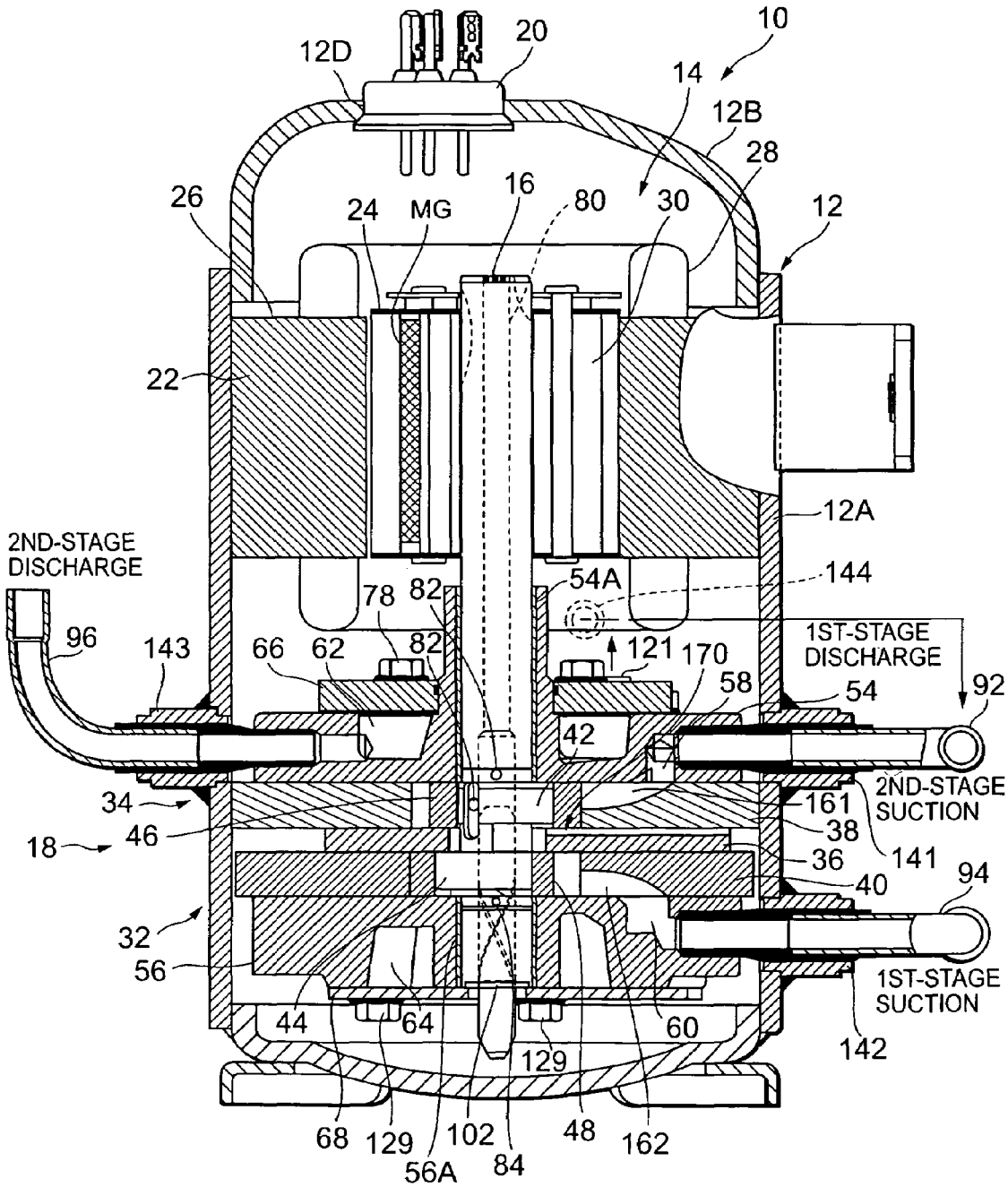
FIG. 7 is a longitudinal sectional view of an internal intermediate pressure multistage compression type rotary compressor according to another embodiment of the present invention.

FIG. 7 is a longitudinal sectional view of another internal intermediate pressure multistage (2-stage) compression type rotary compressor 10, which is an embodiment of a rotary compressor in accordance with the present invention. The rotary compressor 10 has a first rotary compressing element 32 and a second rotary compressing element 34.

Referring to FIG. 7, the internal intermediate pressure multistage compression type rotary compressor 10 that uses carbon dioxide ($CO_2$) as a refrigerant is constructed of a cylindrical hermetically sealed vessel 12 formed of a steel plate, a driving element 14 disposed at an upper side of the internal space of the hermetically sealed vessel 12, and a rotary compressing mechanism unit 18 that includes a first rotary compressing element 32 (first stage) and a second rotary compressing element 34 (second stage) that are disposed under the driving element 14 and driven by a rotary shaft 16 of the driving element 14.

The hermetically sealed vessel 12 having its bottom portion working as an oil reservoir is constructed of a vessel main body 12A accommodating the driving element 14 and the rotary compressing mechanism unit 18, and a substantially bowl-shaped end cap or cover 12B that closes an upper opening of the vessel main body 12A. A circular mounting hole 12D is formed at the center of an upper surface of the end cap 12B. A terminal (wires not shown) 20 for supplying electric power to the driving element 14 is installed in the mounting hole 12D.

The driving element 14 is a series-wound DC motor constructed of a stator 22 annularly installed along an upper inner peripheral surface of the hermetically sealed vessel 12 and a rotor 24 inserted in the stator 22 with a slight gap on the inner side. The rotational speed and torque of the driving element 14 is controlled by an inverter. The rotational speed of the driving element 14 is controlled by the inverter so that the driving element 14 is actuated at low speed when starting up the rotary compressor 10, and then increased to a desired speed. The rotor 24 is fixed to the rotary shaft 16 that extends in a vertical direction, passing through a center.

The stator 22 has a laminate 26 formed of stacked toroidal electromagnetic steel plates, and a stator coil 28 wound around teeth of the laminate 26 by a series winding (concentrated winding) method. The rotor 24 is also formed of a laminate 30 made of electromagnetic steel plates, as in the stator 22. A permanent magnet MG is inserted in the laminate 30.

An oil pump 102, serving as a lubricating device, is provided at the bottom end of the rotary shaft 16. The oil pump 102 sucks up lubricating oil from the oil reservoir formed at the bottom of the hermetically sealed vessel 12. The lubricating oil passes through an oil bore 80 formed in a vertical direction along the axial center of the rotary shaft 16 and through horizontal lubrication bores 82 and 84 (formed also in upper and lower eccentric members 42 and 44) in communication with the oil bore 80 to reach sliding portions and the like of the upper and lower eccentric members 42 and 44, and the first and second rotary compressing elements 32 and 34. This restrains wear on the first and second rotary compressing elements 32 and 34, and provides sealing.

The rotary compressing mechanism unit 18 includes a lower cylinder (first cylinder) 40 constituting the first rotary compressing element 32 and an upper cylinder (second cylinder) 38 constituting the second rotary compressing element 34, upper and lower rollers 46 and 48, which eccentrically rotate, being fitted onto the upper and lower eccentric members 42 and 44, respectively, which are provided on the rotary shaft 16 with a 180-degree phase difference in the upper and lower cylinders 38 and 40, respectively, an intermediate partitioner 36 provided between the cylinders 38 and 40 and the rollers 46 and 48 to separate the first and second rotary compressing elements 32 and 34, a vane 50 (the lower vane being not shown) abutting against the rollers 46 and 48 to separate interiors of the upper and lower cylinders 38 and 40 to low-pressure chambers and high-pressure chambers, and an upper supporting member 54 and a lower supporting member 56 that cover the upper opening surface of the upper cylinder 38 and the lower opening surface of the lower cylinder 40, respectively, and also serve as bearings of the rotary shaft 16.

The upper supporting member 54 and the lower supporting member 56 are provided with suction passages 58 and 60 in communication with the interiors of the upper and lower cylinders 38 and 40, respectively, through suction ports 161 and 162, respectively, and discharge muffling chambers 62 and 64 partly formed by recessions that are closed by an upper cover 66 and a lower cover 68, respectively. A bearing 54A is protuberantly formed at the center of the upper supporting member 54 and a bearing 56A is protuberantly formed at the center of the lower supporting member 56 to support the rotary shaft 16.

The lower cover 68 is formed of a toroidal steel plate and fixed to the lower supporting member 56 from below by main bolts 129 at four peripheral locations. Distal ends of the main bolts 129 are screwed into the upper supporting member 54.

The discharge muffling chamber 64 of the first rotary compressing element 32 and the interior of the hermetically sealed vessel 12 are in communication through a communication passage. The communication passage is formed of a bore (not shown) that penetrates the lower supporting member 56, the upper supporting member 54, the upper cover 66, the upper and lower cylinders 38 and 40, and the intermediate partitioner 36. In this case, an intermediate discharge pipe 121 is vertically provided at the upper end of the communication passage, and an intermediate-pressure refrigerant is discharged through the intermediate discharge pipe 121 into the hermetically sealed vessel 12.

The upper cover 66 closes the upper surface opening of the discharge muffling chamber 62 in communication with the interior of the upper cylinder 38 of the second rotary compressing element 34 through a discharge port 39. The driving element 14 is provided above the upper cover 66 with a predetermined gap therebetween in the hermetically sealed vessel 12. A peripheral portion of the upper cover 66 is fixed to the upper supporting member 54 from above by four main bolts 78. The distal ends of the main bolts 78 are screwed in the lower supporting members 56.

Figure 8:
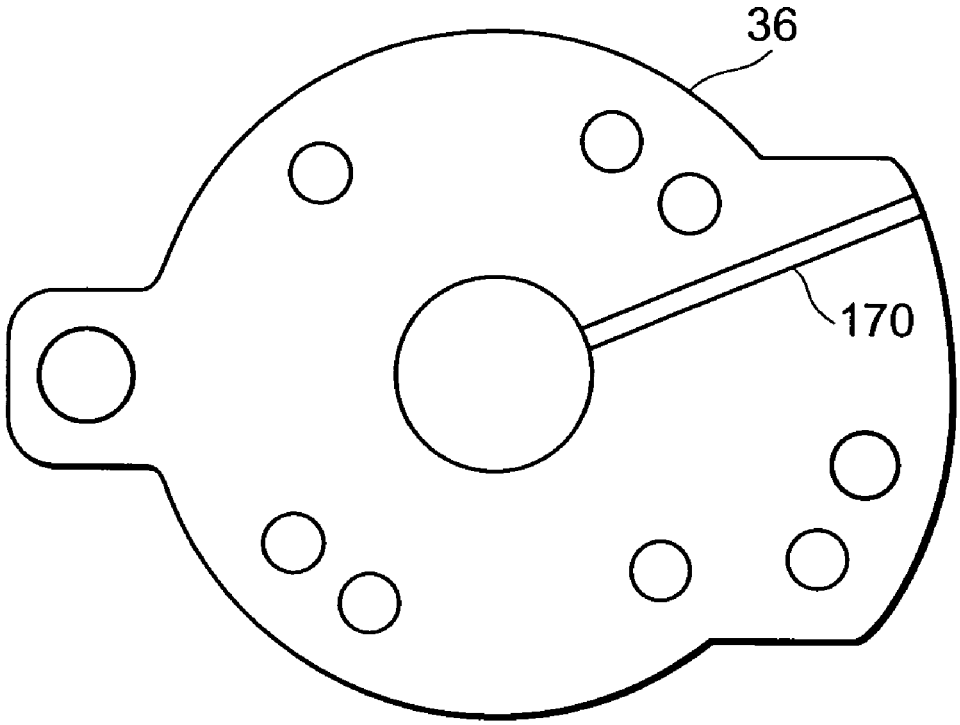
FIG. 8 is a top plan view of an intermediate partitioner of the rotary compressor shown in FIG. 7.
Figure 9:
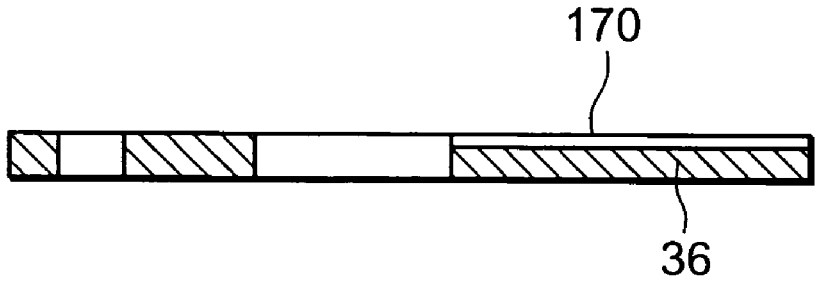
FIG. 9 is a longitudinal sectional view of the intermediate partitioner of the rotary compressor shown in FIG. 7.
Figure 10:
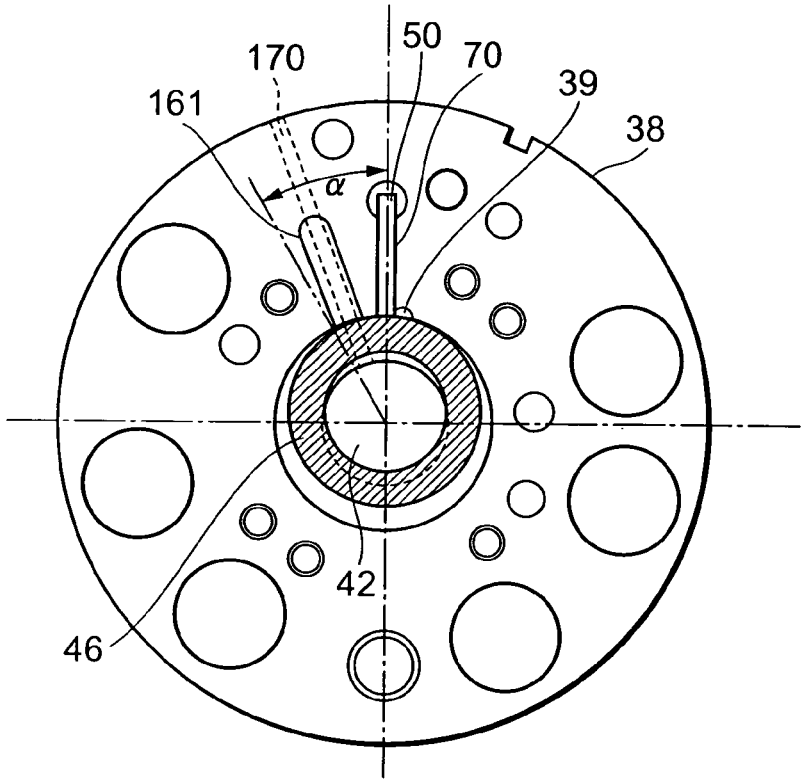
FIG. 10 is a top plan view of a cylinder of a second rotary compressing element of the rotary compressor shown in FIG. 7.

The surface of the intermediate partitioner 36 that is adjacent to the cylinder 38 has a through groove 170 that extends from the inner periphery to the outer periphery of the intermediate partitioner 36, as shown in FIG. 8 and FIG. 10. The through groove 170 provides communication between lubrication bores 82, 84 in communication with an oil bore 80, and the inside of the roller 46 and the low-pressure chamber of the cylinder 38. FIG. 8 is a top plan view of the intermediate partitioner 36, FIG. 9 is a longitudinal sectional view of the intermediate partitioner 36, and FIG. 10 is a top plan view of the upper cylinder 38.

A small gap is formed between the intermediate partitioner 36 and the rotary shaft 16, an upper side of the gap being in communication with the inside of the roller 46 (the space around the eccentric member 42 inside the roller 46). Furthermore, the gap between the intermediate partitioner 36 and the rotary shaft 16 has its lower side in communication with the inside of the roller 48 (the space around the eccentric member 44 inside the roller 48). The low-pressure chamber of the cylinder 38 and the inner periphery of the intermediate partitioner 36 are in communication through the through groove 170, as shown in FIG. 9. The through groove 170 is formed beneath an area a extending from a position where the vane 50 of the upper cylinder 38 shown in FIG. 10 abuts against the roller 46 to an edge on the opposite side from the vane 50 of the suction port 161.

A high-pressure refrigerant gas that leaks inside the roller 46 (the space around the eccentric member 42 inside the roller 46) through the gap formed between the roller 46 in the cylinder 38 and the upper supporting member 54 that closes the upper opening surface of the cylinder 38 or the intermediate partitioner 36 that closes the lower opening surface thereof, and flows into the gap between the intermediate partitioner 36 and the rotary shaft 16 and inside the roller 48 can be released into the hermetically sealed vessel 12 through the through groove 170.

In other words, the high-pressure refrigerant gas leaking inside the roller 46 passes through the gap formed between the intermediate partitioner 36 and the rotary shaft 16, enters the through groove 170, and flows into the hermetically sealed vessel 12 via the through groove 170.

Thus, the high-pressure refrigerant gas leaking inside the roller 46 can be released through the through groove 170 into the hermetically sealed vessel 12. This makes it possible to avoid the inconvenience of the high-pressure refrigerant gas accumulating inside the roller 46, in the gap between the intermediate partitioner 36 and the rotary shaft 16, and inside the roller 48. With this arrangement, oil can be supplied inside the roller 46 and the roller 48 through the lubrication bores 82 and 84 of the rotary shaft 16 by making use of a pressure difference.

An increase in machining cost can be minimized particularly because a high-pressure refrigerant gas leaked inside the roller 46 can be released into the hermetically sealed vessel 12 simply by forming the through groove 170 horizontally penetrating the intermediate partitioner 36.

The rotary shaft 16 includes the oil bore 80 formed in the vertical direction along an axial center and horizontal lubrication bores 82 and 84 (formed also in the upper and lower eccentric members 42 and 44) that are in communication with the oil bore 80. The inner periphery of the through groove 170 of the intermediate partitioner 36 is in communication with the oil bore 80 via the lubrication bores 82 and 84. Thus, the through groove 170 provides communication between the oil bore 80 and the low-pressure chamber in the cylinder 38 via the lubrication bores 82 and 84.

In this case, as will be discussed hereinafter, the inside of the hermetically sealed vessel 12 has an intermediate pressure, so that it is difficult to supply oil into the upper cylinder 38 that has a high pressure in the second stage. However, the through groove 170 formed in the intermediate partitioner 36 causes the oil to be drawn up from the oil reservoir at the bottom in the hermetically sealed vessel 12 and moved up through the oil bore 80. The oil coming out of the lubrication bores 82 and 84 enters the through groove 170 of the intermediate partitioner 36 so as to be supplied to the low-pressure chamber (suction side) of the upper cylinder 38.

Figure 11:
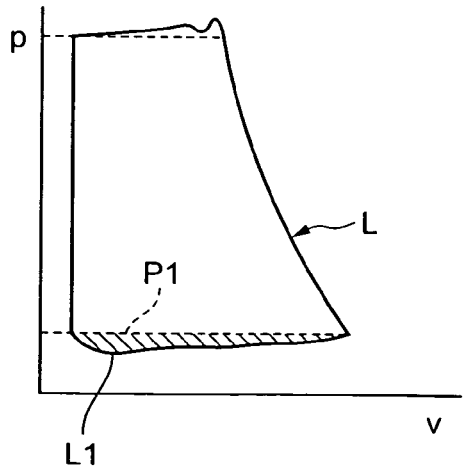
FIG. 11 is a diagram showing changes in pressure at an inlet end of an upper cylinder of the rotary compressor shown in FIG. 7.

FIG. 11 shows changes in pressure in the upper cylinder 38, P1 in the diagram denoting a pressure on the inner peripheral side of the intermediate partitioner 36. The internal pressure (suction pressure) of the low-pressure chamber of the upper cylinder 38 in the diagram drops below the pressure P1 on the inner peripheral side of the intermediate partitioner 36 due to a suction pressure loss in a suction stroke. During that particular period, oil is injected through the oil bore 80 of the rotary shaft 16 into the low-pressure chamber in the upper cylinder 38 through the through groove 170 of the intermediate partitioner 36, thus accomplishing lubrication.

As described above, the through groove 170 allows the high-pressure refrigerant gas leaking inside the roller 46 to be released into the hermetically sealed vessel 12. In addition, even if the pressure in the cylinder 38 of the second rotary compressing element 34 becomes higher than that in the hermetically sealed vessel 12 whose pressure reaches an intermediate pressure, a suction pressure loss in the course of suction in the second rotary compressing element 34 can be utilized to reliably supply oil into the cylinder 38.

Moreover, simply forming the through groove 170 extending from the inner periphery to the outer periphery of the intermediate partitioner 36 makes it possible to release high pressures inside the roller 46 and also to reliably supply oil to the second rotary compressing element 34. This obviates the conventional need for separately providing a bore for releasing high pressures in the roller 46 and a bore for supplying oil to the second rotary compressing element 34, or for forming the bores for supplying oil in the two members, namely, the intermediate partitioner 36 and the cylinder 38. Thus, improved performance and higher reliability of a compressor can be achieved with a simple structure and at low cost.

In summary, the problem in that the pressure inside the roller 46 of the second rotary compressing element becomes high can be solved, and the lubrication of the second rotary compressing element 34 can be reliably accomplished, thus permitting the rotary compressor 10 to provide secured performance and improved reliability.

Furthermore, as mentioned above, the rotational speed of the driving element 14 is controlled by an inverter so as to be started up at low speed when actuating the compressor. Therefore, at the startup of the rotary compressor 10, it is possible to restrain adverse effect caused by compressing a liquid when oil is drawn in from the oil reservoir at the inner bottom of the hermetically sealed vessel 12 through the through groove 170, permitting deterioration of reliability to be avoided.

In this embodiment also, carbon dioxide ($CO_2$), which is a natural refrigerant gentle to the global environment, is used, considering flammability, toxicity, etc. Oil sealed in the hermetically sealed vessel 12 as a lubricant may be an existing oil, such as a mineral oil, alkyl benzene oil, ether oil, ester oil, and polyalkylene glycol (PAG).

A side surface of the vessel main body 12A of the hermetically sealed vessel 12 has sleeves 141, 142, 143, and 144 welded and fixed at positions matching the positions of the suction passages 58 and 60 of the upper supporting member 54 and the lower supporting member 56, the discharge muffling chamber 62, and above the upper cover 66 (a position substantially matching the bottom end of the driving element 14), respectively. The sleeves 141 and 142 are vertically adjacent, while the sleeve 143 is positioned substantially on a diagonal line with respect to the sleeve 141. Positionally, the sleeve 144 and the sleeve 141 are shifted by about 90 degrees.

One end of a refrigerant introduction pipe 92 for introducing a refrigerant gas into the upper cylinder 38 is inserted in and connected to the sleeve 141, and the end of the refrigerant introduction pipe 92 is in communication with the suction passage 58 of the upper cylinder 38. The refrigerant introduction pipe 92 is routed above the hermetically sealed vessel 12 to the sleeve 144, the other end thereof being inserted in and connected to the sleeve 144 to be in communication with the interior of the hermetically sealed vessel 12.

One end of the refrigerant introduction pipe 94 for introducing a refrigerant gas into the lower cylinder 40 is inserted in and connected to the sleeve 142, the one end of the refrigerant introduction pipe 94 being in communication with the suction passage 60 of the lower cylinder 40. A refrigerant discharge pipe 96 is inserted in and connected to the sleeve 143, one end of the refrigerant discharge pipe 96 being in communication with the discharge muffling chamber 62.

An operation of the rotary compressor 10 having the aforementioned construction will now be described. Before the rotary compressor 10 is started up, the oil level (oil surface) in the hermetically sealed vessel 12 is normally above an opening of the through groove 170 formed in the intermediate partitioner 36, the opening being adjacent to the hermetically sealed vessel 12. This causes the oil in the hermetically sealed vessel 12 to flow into the through groove 170 from the opening of the through groove 170 that is adjacent to the hermetically sealed vessel 12.

Energizing the stator coil 28 of the driving element 14 by the inverter via the terminal 20 and the wires (not shown) actuates the driving element 14 to rotate the rotor 24. As mentioned above, the speed is low at the startup, and then increased. This causes the upper and lower rollers 46 and 48 to eccentrically rotate in the upper and lower cylinders 38 and 40, respectively, the rollers 46 and 48 being fitted to the upper and lower eccentric members 42 and 44, respectively, that are integrally formed with the rotary shaft 16.

A refrigerant gas of a low pressure (4 MPaG) drawn into the low-pressure chamber of the lower cylinder 40 through the suction port 162 via the refrigerant introduction pipe 94 and the suction passage 60 formed in the lower supporting member 56 is compressed to have an intermediate pressure (8 MPaG) by the roller 48 and a vane (not shown), passes through the discharge port 41 from the high-pressure chamber of the lower cylinder 40 into the discharge muffling chamber 64 formed in the lower supporting member 56, and then it is discharged into the hermetically sealed vessel 12 through the intermediate discharge pipe 121 via a communication passage (not shown).

Then, the intermediate-pressure refrigerant gas in the hermetically sealed vessel 12 leaves the sleeve 144, passes through the refrigerant introduction pipe 92 and the suction passage 58 formed in the upper supporting member 54, and reaches the low-pressure chamber of the upper cylinder 38 through the suction port 161.

When the rotary compressor 10 is activated, the oil that has entered from the opening of the through groove 170 adjacent to the hermetically sealed vessel 12 is drawn into the low-pressure chamber of the cylinder 38 of the second rotary compressing element 34. The intermediate-pressure refrigerant gas and oil drawn into the low-pressure chamber of the cylinder 38 are subjected to the second-stage compression by the roller 46 and the vane 50 so as to turn into a hot, high-pressure refrigerant gas (12 MPaG).

In this case, the oil that has entered together with the intermediate-pressure refrigerant gas from the opening of the through groove 170 adjacent to the hermetically sealed vessel 12 is also compressed. However, the rotational speed of the rotary compressor 10 is controlled by the inverter such that the rotary compressor 10 is operated at low speed at a startup, so that the torque is small. Therefore, the compressed oil hardly affects the rotary compressor 10, allowing normal operation to be performed.

The rotational speed is increased according to a predetermined control pattern, and the driving element 14 is eventually operated at a desired rotational speed. Although the oil level lowers below the through groove 170 during the operation, oil is supplied through the through groove 170 to the low-pressure chamber of the upper cylinder 38, making it possible to avoid shortage of oil supplied to the sliding portions of the second rotary compressing element 34.

Thus, the through groove 170 extending from the inner periphery to the outer periphery of the intermediate partitioner 36 is formed in the surface of the intermediate partitioner 36 adjacent to the cylinder 38 so as to provide communication among the oil bore 80, the inside of the roller 46, the low-pressure chamber of the cylinder 38, and the hermetically sealed vessel 12. With this arrangement, a high-pressure refrigerant gas leaked inside the roller 46 can be released through the through groove 170 into the hermetically sealed vessel 12.

Thus, oil is smoothly supplied inside the roller 46 and the roller 48 through the lubrication bores 82 and 84 of the rotary shaft 16 by making use of a pressure difference. This makes it possible to avoid shortage of oil around the eccentric member 42 inside the roller 46 and around the eccentric member 44 inside the roller 48.

Furthermore, even if the pressure in the cylinder 38 of the second rotary compressing element 34 becomes higher than the intermediate pressure in the hermetically sealed vessel 12, the through groove 170 allows oil to be securely supplied into the low-pressure chamber of the cylinder 38 by making use of a suction pressure loss during a suction stroke in the second rotary compressing element 34.

In summary, the problem in that the pressure inside the roller 46 becomes high can be solved, and the lubrication of the second rotary compressing element 34 can be reliably accomplished, thus permitting the rotary compressor 10 to provide secured performance and improved reliability.

Furthermore, the driving element 14 is an rpm-controlled motor activated at low speed at a startup. Therefore, at the startup of the rotary compressor 10, it is possible to restrain adverse effect caused by compressing a liquid when oil is drawn in from the oil reservoir at the inner bottom of the hermetically sealed vessel 12 through the through groove 170, permitting deterioration of reliability to be avoided.

In the present embodiment, the upper side of the gap formed between the intermediate partitioner 36 and the rotary shaft 16 is in communication with the inside of the roller 46, while the lower side thereof is in communication with the inside of the roller 48. Alternatively, however, only the upper side of the gap formed between the intermediate partitioner 36 and the rotary shaft 16 may be in communication with the inside of the roller 46, that is, the lower side thereof may not be in communication with the inside of the roller 48. Further alternatively, the inside of the roller 46 and the inside of the roller 48 may be separated by the intermediate partitioner 36. In this case also, a high pressure inside the roller 46 can be released into the hermetically sealed vessel 12 by forming a bore in an axial direction that is in communication with the inside of the roller 46 in a middle of the through groove 170 of the intermediate partitioner. Moreover, oil can be supplied to the low-pressure chamber of the cylinder 38 through the lubrication bore 82.

As explained in detail above, in the rotary compressor in accordance with the present invention, the groove extending from the inner periphery to the outer periphery of the intermediate partitioner allows a high-pressure refrigerant gas accumulating in the roller to be released into the hermetically sealed vessel.

Thus, oil is smoothly supplied inside the rollers through the lubrication bores of the rotary shaft by making use of a pressure difference. This makes it possible to avoid shortage of oil around the eccentric members inside the rollers.

Furthermore, even if the pressure in the second cylinder of the second rotary compressing element becomes higher than the intermediate pressure in the hermetically sealed vessel, the groove formed in the intermediate partitioner allows oil to be securely supplied into the low-pressure chamber of the second cylinder of the second rotary compressing element through the oil bores in the rotary shaft by making use of a suction pressure loss during a suction stroke in the second rotary compressing element.

The aforementioned construction therefore enables the rotary compressor to provide secured performance and improved reliability. In particular, a high pressure in a roller can be released and oil can be supplied to the second rotary compressing element simply by forming the groove that provides communication between the hermetically sealed vessel and the inside of the roller. This permits a simplified construction and reduced cost to be achieved.

Furthermore, the driving element is constructed of an rpm-controlled motor activated at low speed at a startup. Therefore, it is possible to restrain adverse effect caused by compressing a liquid when the second rotary compressing element draws oil in at a startup from the hermetically sealed vessel through the through groove in the intermediate partitioner in communication with the hermetically sealed vessel. This restrains the reliability of the rotary compressor from deteriorating.

Figure 12:
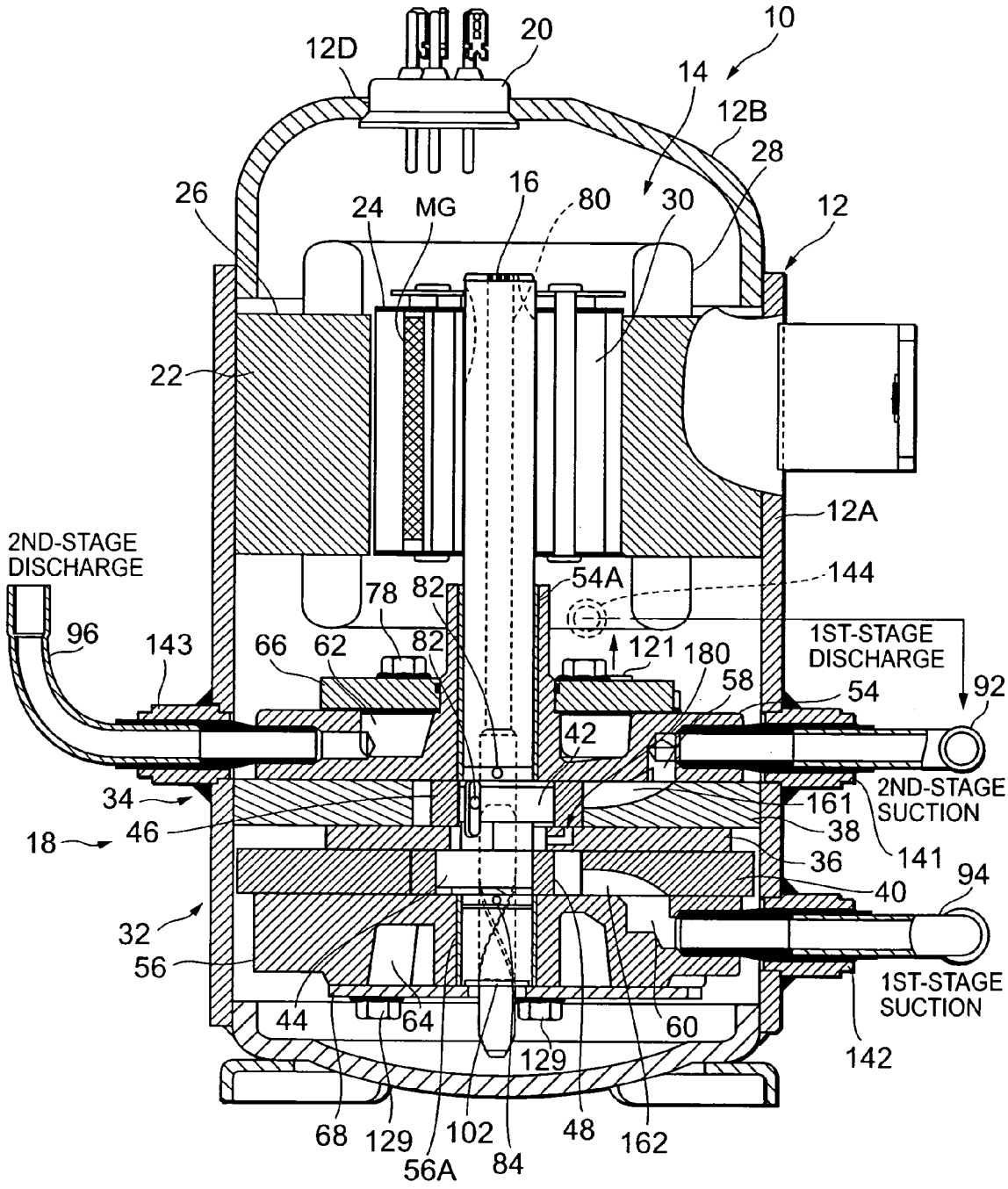
FIG. 12 is a longitudinal sectional view of a rotary compressor according to another embodiment of the present invention.
Figure 13:
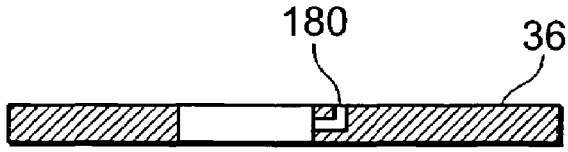
FIG. 13 is a sectional view of an intermediate partitioner of the rotary compressor shown in FIG. 12.

FIG. 12 is a longitudinal sectional view of still another internal intermediate pressure multistage (2-stage) compression type rotary compressor 10, which is an embodiment of a rotary compressor in accordance with the present invention. The rotary compressor 10 has a first rotary compressing element 32 and a second rotary compressing element 34.

Referring to FIG. 12, the internal intermediate pressure multistage (2-stage) compression type rotary compressor 10 that uses carbon dioxide ($CO_2$) as a refrigerant is constructed of a cylindrical hermetically sealed vessel 12 formed of a steel plate, a driving element 14 disposed at an upper side of the internal space of the hermetically sealed vessel 12, and a rotary compressing mechanism unit 18 that includes a first rotary compressing element 32 (first stage) and a second rotary compressing element 34 (second stage) that are disposed under the driving element 14 and driven by a rotary shaft 16 of the driving element 14.

The hermetically sealed vessel 12 having its bottom portion working as an oil reservoir is constructed of a vessel main body 12A accommodating the driving element 14 and the rotary compressing mechanism unit 18, and a substantially bowl-shaped end cap or cover 12B that closes an upper opening of the vessel main body 12A. A terminal (wires not shown) 20 for supplying electric power to the driving element 14 is installed on the top surface of the end cap 12B.

The driving element 14 is constructed of a stator 22 annularly installed along an upper inner peripheral surface of the hermetically sealed vessel 12 and a rotor 24 inserted in the stator 22 with a slight gap on the inner side. The rotor 24 is fixed to the rotary shaft 16 that extends in a vertical direction, passing through a center.

The stator 22 has a laminate 26 formed of stacked toroidal electromagnetic steel plates, and a stator coil 28 wound around teeth of the laminate 26 by a series winding (concentrated winding) method. The rotor 24 is also formed of a laminate 30 made of electromagnetic steel plates, as in the stator 22. A permanent magnet MG is inserted in the laminate 30.

Figure 15:
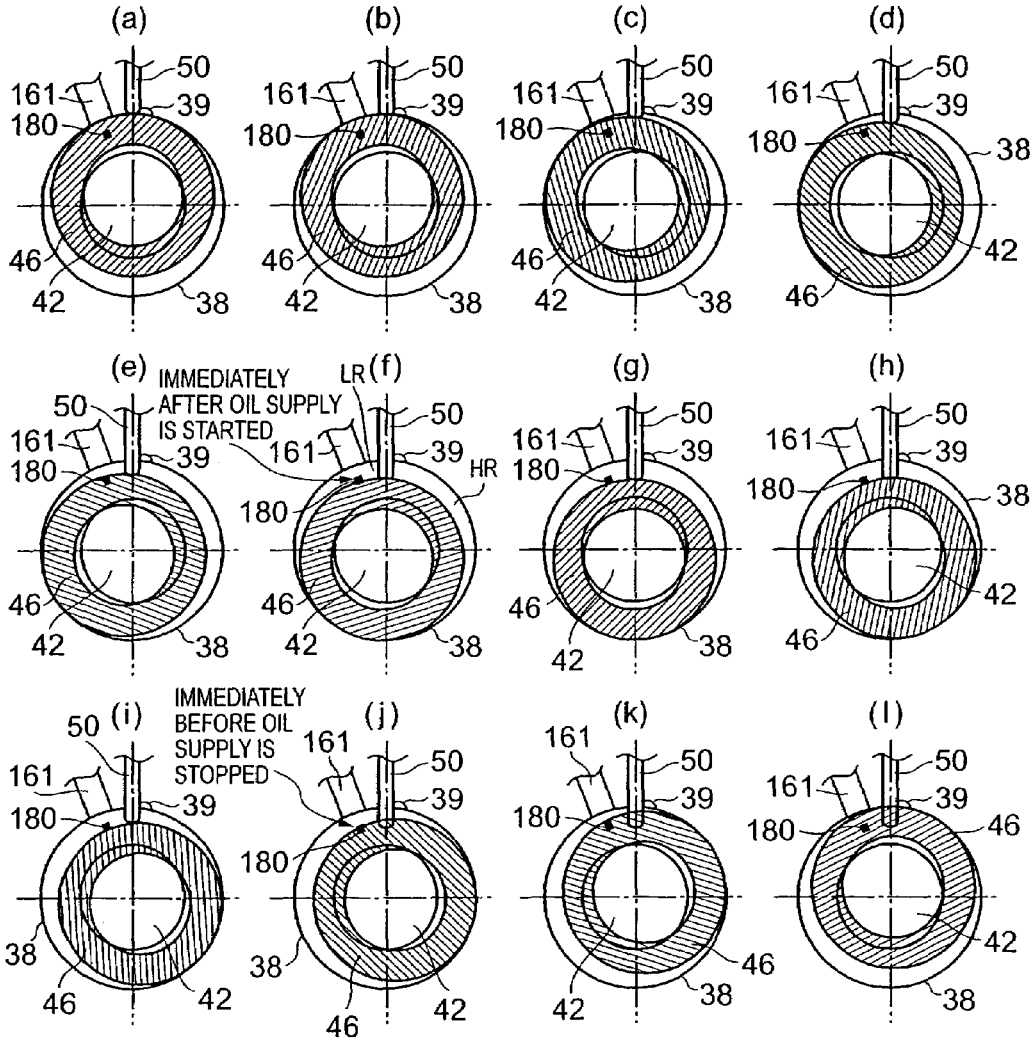
FIG. 15 is a diagram illustrating a stroke of suction-compression of a refrigerant performed by the upper cylinder of the rotary compressor shown in FIG. 12.
Figure 16:
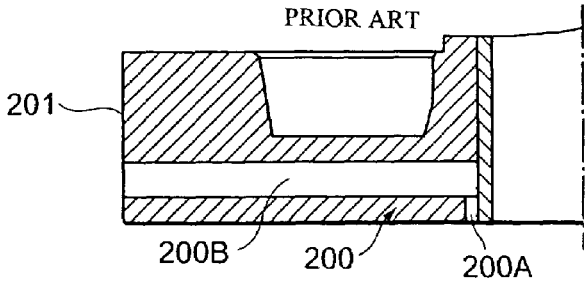
FIG. 16 PRIOR ART
FIG. 16 is a longitudinal sectional view of an upper supporting member of a conventional rotary compressor.

The rotary compressing mechanism unit 18 includes a lower cylinder (first cylinder) 40 constituting the first rotary compressing element 32 and an upper cylinder (second cylinder) 38 constituting the second rotary compressing element 34, upper and lower rollers 46 and 48, which eccentrically rotate, being fitted onto the upper and lower eccentric members 42 and 44, respectively, which are provided on the rotary shaft 16 with a 180-degree phase difference in the upper and lower cylinders 38 and 40, respectively, an intermediate partitioner 36 provided between the cylinders 38 and 40 and the rollers 46 and 48 to separate the first and second rotary compressing elements 32 and 34, a vane 50 (the lower vane being not shown) abutting against the rollers 46 and 48 to separate interiors of the upper and lower cylinders 38 and 40 to a low-pressure chamber LR (FIG. 15F) and a high-pressure chamber (FIG. 15F), and an upper supporting member 54 and a lower supporting member 56 that cover the upper opening surface of the upper cylinder 38 and the lower opening surface of the lower cylinder 40, respectively, and also serve as bearings of the rotary shaft 16.

The upper supporting member 54 and the lower supporting member 56 are provided with suction passages 58 and 60 in communication with the interiors of the upper and lower cylinders 38 and 40, respectively, through suction ports 161 and 162, respectively, and discharge muffling chambers 62 and 64 partly formed by recessions that are closed by an upper cover 66 and a lower cover 68, respectively. A bearing 54A is protuberantly formed at the center of the upper supporting member 54 and a bearing 56A is protuberantly formed at the center of the lower supporting member 56 to fixedly support the rotary shaft 16.

In this case, the lower cover 68 formed of a toroidal steel plate and fixed to the lower supporting member 56 from below by main bolts 129 at four peripheral locations closes a lower opening of the discharge muffling chamber 64 in communication with the interior of the lower cylinder 40 of the first rotary compressing element 32 at a discharge port (not shown). Distal ends of the main bolts 129 are screwed into the upper supporting member 54.

The discharge muffling chamber 64 and the side of the upper cover 66 that is closer to the driving element 1–4 in the hermetically sealed vessel 12 are in communication through a communication passage (not shown) that penetrates the upper and lower cylinders 38 and 40 and the intermediate partitioner 36. In this case, an intermediate discharge pipe 121 is vertically provided at the upper end of the communication passage, and the intermediate discharge pipe 121 is directed toward the gap between adjoining stator coils 28 and 28 wound around the stator 22 of the above driving element 14.

The upper cover 66 closes the upper surface opening of the discharge muffling chamber 62 in communication with the interior of the upper cylinder 38 of the second rotary compressing element 34 through a discharge port 39. The driving element 14 is provided above the upper cover 66 with a predetermined gap therebetween in the hermetically sealed vessel 12. A peripheral portion of the upper cover 66 is fixed to the upper supporting member 54 from above by four main bolts 78. The distal ends of the main bolts 78 are screwed in the lower supporting members 56.

Figure 14:
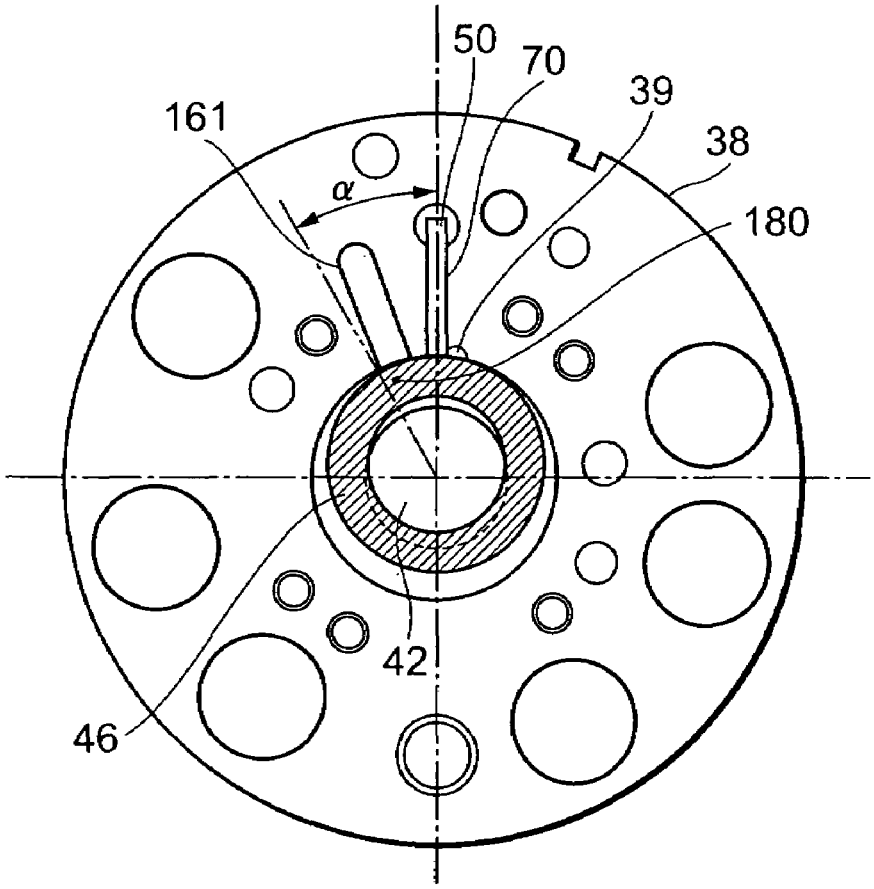
FIG. 14 is a top plan view of an upper cylinder 38 of the rotary compressor shown in FIG. 12.

FIG. 14 is a top plan view of the upper cylinder 38 of the second rotary compressing element 34. An accommodating chamber 70 is formed in the upper cylinder 38. The vane 50 is housed in the accommodating chamber 70 and abutted against the roller 46. One side (right side in FIG. 14) of the vane 50 has the discharge port 39, while the other side (left) with the vane 50 therebetween has the suction port 161. The vane 50 separates compression chambers formed between the upper cylinder 38 and the roller 46 into low-pressure chambers LR and high-pressure chambers HR. The suction port 161 is associated with the low-pressure chambers LR, while the discharge port 39 is associated with the high-pressure chambers HR.

The intermediate partitioner 36, which is substantially toroidal, closes the lower opening surface of the upper cylinder 38 and the upper opening surface of the lower cylinder 40. The intermediate partitioner 36 has a lubrication bore 180 that provides communication between the oil bore 80, which will be discussed later, and the low-pressure chamber LR of the upper cylinder 38. More specifically, the lubrication bore 180 provides communication between the low-pressure chamber LR of the upper cylinder 38 on the upper surface of the intermediate partitioner 36 (the surface adjacent to the upper cylinder 38) and the inner peripheral surface of the intermediate partitioner 36, the upper end thereof being open in the low-pressure chamber LR of the upper cylinder 38. The lubrication bore 180 is formed under an area a extending from a position where the vane 50 of the upper cylinder 38 shown in FIG. 14 abuts against the roller 46 to an edge on the opposite side from the vane 50 of the suction port 161. The upper end of the lubrication bore 180 is in communication with the low-pressure chamber LR (suction side) in the upper cylinder 38.

The rotary shaft 16 includes the oil bore 80 formed in the vertical direction along an axial center thereof and horizontal lubrication bores 82 and 84 (formed also in the upper and lower eccentric members 42 and 44) that are in communication with the oil bore 80. The opening of the lubrication bore 180 in the intermediate partitioner.36, which opening is on the inner periphery end, is in communication with the oil bore 80 via the lubrication bores 82 and 84. Thus, the lubrication bore 180 provides communication between the oil bore 80 and the low-pressure chamber LR in the upper cylinder 38.

As will be discussed hereinafter, the pressure inside the hermetically sealed vessel 12 reaches an intermediate level, so that it is difficult to supply oil into the upper cylinder 38 whose interior pressure reaches a high level in the second stage. However, the lubrication bore 180 formed in the intermediate partitioner 36 lets the oil be drawn up from the oil reservoir at the bottom in the hermetically sealed vessel 12 and move up through the oil bore 80. The oil coming out of the lubrication bores 82 and 84 enters the lubrication bore 180 of the intermediate partitioner 36 so as to be supplied to the low-pressure chamber LR (suction side) of the upper cylinder 38.

The changes in pressure in the upper cylinder 38 in this case are similar to those shown in FIG. 5 discussed above. More specifically, P1 in the diagram denotes a pressure on the inner peripheral side of the intermediate partitioner 36. As indicated by a curve LP in FIG. 5, the internal pressure (suction pressure) of the low-pressure chamber LR of the upper cylinder 38 drops below the pressure P1 on the inner peripheral side of the intermediate partitioner 36 due to a suction pressure loss in a suction stroke. During that particular period, oil is injected through the oil bore 80 of the rotary shaft 16 into the low-pressure chamber LR in the upper cylinder 38 through the lubrication bore 180 of the intermediate partitioner 36, thus accomplishing lubrication.

FIG. 15A through FIG. 15L illustrate a refrigerant suction-compression stroke of the upper cylinder 38 of the second rotary compressing element 34. If it is assumed that the eccentric member 42 of the rotary shaft 16 rotates counterclockwise in the figures, then the suction port 161 is closed by the roller 46 in FIGS. 15A and 15B. In FIG. 15C, the suction port 161 opens and suction of a refrigerant is begun, while a refrigerant is being discharged at the opposite side. The suction of the refrigerant continues during the steps of FIGS. 15C to 15E. During this period, the lubrication bore 180 is covered by the roller 46.

In FIG. 15F, the roller 46 exposes the lubrication bore 180, so that the oil is drawn into the low-pressure chamber LR surrounded by the vane 50 and the roller 46 in the upper cylinder 38, beginning the lubrication (the beginning of the supply period shown in FIG. 5). From steps shown in FIGS. 15G to 15I, the suction of the oil is performed. The lubrication continues until the upper side of the lubrication bore 180 is covered by the roller 46 in FIG. 15J, thus stopping the lubrication (the end of the supply period shown in FIG. 5). From steps shown in FIGS. 15K through 15L to FIGS. 15A and 15B, suction of a refrigerant is carried out. Thereafter, the refrigerant will be compressed and discharged through the discharge port 39.

In this embodiment, carbon dioxide ($CO_2$), which is a natural refrigerant gentle to the global environment, is used as a refrigerant, considering flammability, toxicity, etc. Oil as a lubricant may be an existing oil, such as a mineral oil, alkyl benzene oil, ether oil, ester oil, and polyalkylene glycol (PAG).

A side surface of a vessel main body 12A of the hermetically sealed vessel 12 has sleeves 141, 142, 143, and 144 welded and fixed at positions matching the positions of the suction passages 58 and 60 of the upper supporting member 54 and the lower supporting member 56, the discharge muffling chamber 62, and above the upper cover 66 (a position substantially matching the bottom end of the driving element 14), respectively. The sleeves 141 and 142 are vertically adjacent, while the sleeve 143 is positioned substantially on a diagonal line with respect to the sleeve 141. Positionally, the sleeve 144 and the sleeve 141 are shifted by about 90 degrees.

One end of a refrigerant introduction pipe 92 for introducing a refrigerant gas into the upper cylinder 38 is inserted in and connected to the sleeve 141, and the end of the refrigerant introduction pipe 92 is in communication with the suction passage 58 of the upper cylinder 38. The refrigerant introduction pipe 92 is routed above the hermetically sealed vessel 12 to the sleeve 144, the other end thereof being inserted in and connected to the sleeve 144 to be in communication with the interior of the hermetically sealed vessel 12.

One end of the refrigerant introduction pipe 94 for introducing a refrigerant gas into the lower cylinder 40 is inserted in and connected to the sleeve 142, the one end of the refrigerant introduction pipe 94 being in communication with the suction passage 60 of the lower cylinder 40. A refrigerant discharge pipe 96 is inserted in and connected to the sleeve 143, one end of the refrigerant discharge pipe 96 being in communication with the discharge muffling chamber 62.

An operation of the rotary compressor 10 having the aforementioned construction will now be described. Energizing the stator coil 28 of the driving element 14 via the terminal 20 and the wires (not shown) actuates the driving element 14 to rotate the rotor 24. This causes the upper and lower rollers 46 and 48 to eccentrically rotate in the upper and lower cylinders 38 and 40, respectively, as mentioned above, the rollers 46 and 48 being fitted to the upper and lower eccentric members 42 and 44, respectively, that are integrally formed with the rotary shaft 16.

A refrigerant gas of a low pressure (about 4 MPaG) drawn into the low-pressure chamber of the lower cylinder 40 through the suction port 162 via the refrigerant introduction pipe 94 and the suction passage 60 formed in the lower supporting member 56 is compressed to have an intermediate pressure (about 8 MPaG) by the roller 48 and a vane (not shown), passes through a discharge port (not shown) from the high-pressure chamber of the lower cylinder 40 into the discharge muffling chamber 64 formed in the lower supporting member 56, and then it is discharged into the hermetically sealed vessel 12 through the intermediate discharge pipe 121 via a communication passage (not shown).

At this time, the intermediate discharge pipe 121 is directed toward the gap between adjoining stator coils 28 and 28 wound around the stator 22 of the above driving element 14. Hence, it is possible to positively supply the refrigerant gas of a relatively low temperature toward the driving element 14, so that temperature rise in the driving element 14 is restrained. This causes the pressure inside the hermetically sealed vessel 12 to reach an intermediate level.

Then, the intermediate-pressure refrigerant gas in the hermetically sealed vessel 12 leaves the sleeve 144, passes through the refrigerant introduction pipe 92 and the suction passage 58 formed in the upper supporting member 54, and reaches the low-pressure chamber LR of the upper cylinder 38 through the suction port 161. The intermediate-pressure refrigerant gas that has been drawn in is subjected to the second-stage compression explained with reference to FIG. 15 by the roller 46 and the vane 50 so as to turn into a hot, high-pressure refrigerant gas (the pressure being about 12 MPaG). The hot, high-pressure refrigerant gas flows from the high-pressure chamber HR, passes through the discharge port 39, the discharge muffling chamber 62 formed in the upper supporting member 54, and the refrigerant discharge pipe 96, and then it is discharged to an external radiator or the like of the compressor 10.

Thus, oil is securely supplied through the lubrication bore 180 into the upper cylinder 38 of the second rotary compressing element 34 of the compressor 10, as mentioned above. This makes it possible to avoid the inconvenient shortage of oil supplied to the second rotary compressing element 34.

This arrangement ensures reliable lubrication of the second rotary compressing element 34, permitting secured performance and higher reliability. The lubrication bore 180, in particular, can be made simply by providing the intermediate partitioner 36 with the horizontal bore in communication with the oil bore 80 and a vertical bore in communication with the low-pressure chamber LR of the upper cylinder 38. Hence, the construction can be simplified and an increase of production cost can be controlled, as compared with the conventional construction in which the bores are formed in the intermediate partitioner and the cylinder of the second rotary compressing element.

If the construction for lubricating the second rotary compressing element 34 is such that a groove is formed in the upper surface of the intermediate partitioner 36 (the surface adjacent to the upper cylinder 38) from the inner peripheral surface in the radial direction of the upper cylinder 38, and the outer diameter portion of the groove is in communication with the low-pressure chamber LR of the upper cylinder 38, then the area in which the groove and the low-pressure chamber LR of the upper cylinder 38 are in communication varies, depending on the position of the roller 46. This makes it extremely difficult to adjust the amount of oil supplied into the cylinder 38.

According to the present invention, however, the communication with the low-pressure chamber LR of the upper cylinder 38 through the lubrication bore 180 makes it possible to adjust the diameter of the bore and the position of the communication with the low-pressure chamber LR of the upper cylinder 38, thus permitting arbitrary adjustment of the amount of oil supplied into the upper cylinder 38. In adjustment of the position of the communication with the low-pressure chamber LR of the upper cylinder 38, if the position of the communication is set closer toward the rotary shaft 16 (central portion), then the time during which the lubrication bore 180 remains in communication with the low-pressure chamber LR of the upper cylinder 38 by the rotation of the roller 46 is shorter and a smaller amount of oil will be supplied. Setting the aforesaid position of communication farther from the rotary shaft 16 prolongs the time during which the lubrication bore 180 remains in communication with the low-pressure chamber LR of the upper cylinder 38 by the rotation of the roller 46, so that the amount of oil supplied can be increased.

With these features, oil can be smoothly and more securely supplied to the second rotary compressing element 34 at low cost, permitting the rotary compressor 10 to achieve further improved reliability.

As discussed above in detail, the rotary compressor in accordance with the present invention is equipped with a first cylinder for constituting a first rotary compressing element and a second cylinder for constituting a second rotary compressing element, an intermediate partitioner provided between the cylinders to partition the rotary compressing elements, supporting members that close open surfaces of the cylinders and have bearings for the rotary shaft of the driving element, and an oil bore formed in the rotary shaft, wherein a lubrication bore for communication between the oil bore and a low-pressure chamber in the second cylinder is formed in the intermediate partitioner. With this arrangement, even if the pressure in the cylinder of the second rotary compressing element becomes higher than that in the hermetically sealed vessel whose internal pressure reaches an intermediate pressure, a suction pressure loss generated in the course of suction in the second rotary compressing element can be utilized to reliably supply oil into the cylinder through the lubrication bore formed in the intermediate partitioner.

With this arrangement, the lubrication of the second rotary compressing element can be reliably accomplished, so that secured performance and higher reliability can be accomplished. In particular, the lubrication bore can be made simply by forming a bore in the intermediate partitioner, making it possible to simplify the structure and restrain an increase of production cost.

In the embodiments described above, the 2-stage compression type rotary compressors provided with the first and second rotary compression elements have been used; however, the present invention is not limited thereto. For example, the present invention may be applied also to a multistage compression type rotary compressor equipped with rotary compression elements of three stages, four stages, or more stages.

What is claimed is:

1. A rotary compressor having first and second rotary compressing elements driven by a rotary shaft of a driving element in a hermetically sealed vessel to discharge a refrigerant gas, which has been compressed by the first rotary compressing element, into the hermetically sealed vessel, and compress the discharged refrigerant gas of an intermediate pressure by the second rotary compressing element, the rotary compressor comprising:

a first cylinder for constituting a first rotary compressing element and a second cylinder for constituting a second rotary compressing element;

a roller that is provided in each of the cylinders and fitted onto an eccentric member of the rotary shaft to eccentrically rotate;

an intermediate partitioner provided between the cylinders and the rollers to partition the rotary compressing elements;

supporting members that close open surfaces of the cylinders and have bearings for the rotary shaft; and an oil bore formed in the rotary shaft, wherein a surface of the intermediate partitioner that is adjacent to the second cylinder has a groove for communication between the oil bore and a low-pressure chamber in the second cylinder, and the intermediate partitioner has a through bore for communication between an interior of a hermetically sealed vessel and the inside of the rollers.

2. A rotary compressor having first and second rotary compressing elements driven by a rotary shaft of a driving element in a hermetically sealed vessel to discharge a refrigerant gas, which has been compressed by the first rotary compressing element, into the hermetically sealed vessel, and compress the discharged refrigerant gas of an intermediate pressure by the second rotary compressing element, the rotary compressor comprising:

a first cylinder for constituting a first rotary compressing element and a second cylinder for constituting a second rotary compressing element;

a roller that is provided in each of the cylinders and fitted onto an eccentric member of the rotary shaft to eccentrically rotate;

an intermediate partitioner provided between the cylinders and the rollers to partition the rotary compressing elements;

supporting members that close open surfaces of the cylinders and have bearings for the rotary shaft; and an oil bore formed in the rotary shaft, wherein a surface of the intermediate partitioner that is adjacent to the second cylinder has a groove extended from an inner periphery to an outer periphery of the intermediate partitioner to provide communication among the oil bore and the insides of the rollers, a low-pressure chamber in the second cylinder, and the hermetically sealed vessel.

3. The rotary compressor according to claim 2, wherein the driving element is an rpm-controlled motor started up at low speed upon actuation.

4. A rotary compressor having a driving element and first and second rotary compressing elements driven by the driving element in a hermetically sealed vessel to discharge a gas, which has been compressed by the first rotary compressing element, into the hermetically sealed vessel, and compress the discharged gas of an intermediate pressure by the second rotary compressing element, the rotary compressor comprising:

a first cylinder for constituting a first rotary compressing element and a second cylinder for constituting a second rotary compressing element;

an intermediate partitioner provided between the cylinders to partition the rotary compressing elements;

supporting members that close open surfaces of the cylinders and have bearings for the rotary shaft of the driving element; and an oil bore formed in the rotary shaft, wherein a lubrication bore for direct communication between the oil bore and a low-pressure chamber in the second cylinder is formed in the intermediate partitioner.

* * * * *